US006955588B1

(12) United States Patent
Anderson, II et al.

(10) Patent No.: US 6,955,588 B1
(45) Date of Patent: Oct. 18, 2005

(54) METHOD OF AND PLATEN FOR CONTROLLING REMOVAL RATE CHARACTERISTICS IN CHEMICAL MECHANICAL PLANARIZATION

(75) Inventors: Robert L. Anderson, II, Newark, CA (US); Robert Charatan, Portland, OR (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 10/816,431

(22) Filed: Mar. 31, 2004

(51) Int. Cl.[7] ..... B24B 1/00
(52) U.S. Cl. ..... 451/41; 451/307; 451/296
(58) Field of Search ..... 451/41, 296, 303, 451/307, 355, 59, 287, 288, 289

(56) References Cited

U.S. PATENT DOCUMENTS

| | | | |
|---|---|---|---|
| 3,874,123 | A | 4/1975 | Hopkins et al. |
| 4,197,676 | A | 4/1980 | Sauerland |
| 4,556,845 | A | 12/1985 | Strope et al. |
| 4,600,469 | A | 7/1986 | Fusco et al. |
| 4,606,151 | A | 8/1986 | Heynacher |
| 4,793,895 | A | 12/1988 | Kaanta et al. |
| 4,850,152 | A | 7/1989 | Heynacher et al. |
| 5,196,353 | A | 3/1993 | Sandhu et al. |
| 5,240,552 | A | 8/1993 | Yu et al. |
| 5,287,663 | A | 2/1994 | Pierce et al. |
| 5,308,438 | A | 5/1994 | Cote et al. |
| 5,337,015 | A | 8/1994 | Lustig et al. |
| 5,413,941 | A | 5/1995 | Koos et al. |
| 5,433,651 | A | 7/1995 | Lustig et al. |
| 5,508,077 | A | 4/1996 | Chen et al. |
| 5,558,568 | A | 9/1996 | Talieh et al. |
| 5,559,428 | A | 9/1996 | Li et al. |
| 5,575,707 | A | 11/1996 | Talieh et al. |
| 5,584,751 | A | 12/1996 | Kobayashi et al. |
| 5,593,344 | A | 1/1997 | Weldon et al. |
| 5,597,442 | A | 1/1997 | Chen et al. |
| 5,643,050 | A | 7/1997 | Chen |
| 5,647,952 | A | 7/1997 | Chen |
| 5,662,518 | A | 9/1997 | James et al. |
| 5,692,947 | A | 12/1997 | Talieh et al. |
| 5,695,392 | A | 12/1997 | Kim |
| 5,722,877 | A | 3/1998 | Meyer et al. |
| 5,725,414 | A | 3/1998 | Moinpour et al. |
| 5,729,856 | A | 3/1998 | Jang et al. |
| 5,731,697 | A | 3/1998 | Li et al. |
| 5,762,546 | A | 6/1998 | James et al. |
| 5,800,248 | A | 9/1998 | Pant et al. |
| 5,861,066 | A | 1/1999 | Moinpour et al. |
| 5,888,120 | A | 3/1999 | Doran |
| 5,888,126 | A | 3/1999 | Hirose et al. |

(Continued)

FOREIGN PATENT DOCUMENTS

| | | |
|---|---|---|
| EP | 0881039 | 12/1998 |

(Continued)

*Primary Examiner*—Dung Van Nguyen
(74) *Attorney, Agent, or Firm*—Martine Penilla & Gencarella, LLP

(57) ABSTRACT

Methods and a platen control parameters of a removal rate characteristic in chemical mechanical planarization, while allowing a low-cost polishing pad to be used especially in fast edge operations, and while reducing the amount of fluid used to support the polishing pad. Platen configuration provides fluid pressure control to reduce leakage of fluid from beneath the polishing pad, and contributes to control of a location of an inflection point of the removal rate characteristic. Another configuration controls a shape of a section of the removal rate characteristic between the inflection point and a leading wafer edge.

25 Claims, 14 Drawing Sheets

U.S. PATENT DOCUMENTS

| | | | | |
|---|---|---|---|---|
| 5,889,401 | A | 3/1999 | Jourdain et al. | |
| 5,916,012 | A | 6/1999 | Pant et al. | |
| 5,916,015 | A | 6/1999 | Natalicio | |
| 5,931,719 | A | 8/1999 | Nagahara et al. | |
| 5,938,502 | A | 8/1999 | Kubo | |
| 5,944,580 | A | 8/1999 | Kim et al. | |
| 5,958,148 | A | 9/1999 | Holzapfel et al. | |
| 5,961,372 | A | 10/1999 | Shendon | |
| 5,969,521 | A | 10/1999 | Kurita et al. | |
| 5,972,162 | A | 10/1999 | Cesna | |
| 5,980,368 | A | 11/1999 | Chang et al. | |
| 5,985,094 | A | 11/1999 | Mosca | |
| 5,989,104 | A | 11/1999 | Kim et al. | |
| 5,993,302 | A | 11/1999 | Chen et al. | |
| 6,045,431 | A | 4/2000 | Cheprasov et al. | |
| 6,062,959 | A | 5/2000 | Weldon et al. | |
| 6,072,313 | A | 6/2000 | Li et al. | |
| 6,086,456 | A | 7/2000 | Weldon et al. | |
| 6,092,253 | A | 7/2000 | Moinpour et al. | |
| 6,102,786 | A | 8/2000 | Hirose et al. | |
| 6,103,628 | A | 8/2000 | Talieh | |
| 6,106,662 | A | 8/2000 | Bibby, Jr. et al. | |
| 6,108,091 | A | 8/2000 | Pecen et al. | |
| 6,111,634 | A | 8/2000 | Pecen et al. | |
| 6,126,527 | A | 10/2000 | Kao et al. | |
| 6,135,858 | A | 10/2000 | Takahashi | |
| 6,135,859 | A | 10/2000 | Tietz | |
| 6,146,242 | A | 11/2000 | Treur et al. | |
| 6,146,248 | A | 11/2000 | Jairath et al. | |
| 6,246,242 | B1 | 11/2000 | Treur et al. | |
| 6,155,915 | A | 12/2000 | Raeder | |
| 6,186,865 | B1 * | 2/2001 | Thornton et al. | 451/8 |
| 6,224,461 | B1 | 5/2001 | Boehm, Jr. et al. | |
| 6,230,753 | B1 | 5/2001 | Jones et al. | |
| 6,234,878 | B1 | 5/2001 | Moore | |
| 6,261,155 | B1 | 7/2001 | Jairath et al. | |
| 6,261,851 | B1 | 7/2001 | Li et al. | |
| 6,325,706 | B1 * | 12/2001 | Krusell et al. | 451/296 |
| 6,358,118 | B1 | 3/2002 | Boehm et al. | |
| 6,375,540 | B1 | 4/2002 | Mikhaylich et al. | |
| 6,402,589 | B1 | 6/2002 | Inaba et al. | |
| 6,419,559 | B1 | 7/2002 | Gurusamy et al. | |
| 6,550,091 | B1 | 4/2003 | Radman et al. | |
| 6,712,679 | B2 * | 3/2004 | Taylor et al. | 451/303 |
| 2004/0049870 | A1 | 3/2004 | Tolles et al. | |

FOREIGN PATENT DOCUMENTS

| | | | |
|---|---|---|---|
| EP | 0 914 906 A2 | 5/1999 | B24B 37/04 |
| EP | 0920956 | 6/1999 | |
| EP | 0 706 857 B1 | 7/1999 | B24B 37/04 |
| FR | 2767735 | 8/1998 | |
| JP | 03259520 | 11/1991 | |
| JP | 10 144709 A | 5/1998 | |
| WO | WO 00/25982 | 5/2000 | B24B 37/04 |

* cited by examiner 100
106
102S-2
102S-3
102S-4
102S-1
LE 102-2
104
104
146
P2
144
108
102-1
104
104
144
P1
140
147

LE
148
150
150
100
102S-1
102S-2
102S-4
102S-3
108
150
148
TE
140

180

184
C
186
L3
L2
L1
182
INFLECTION POINT IP
Increasing Removal Rate
PERIPHERAL EDGE OF WAFER (LEADING)
CENTER OF WAFER
PERIPHERAL EDGE OF WAFER (TRAILING)
POLISHING PROFILE (REMOVAL RATE CHARACTERISTIC)

METHOD OF AND PLATEN FOR CONTROLLING REMOVAL RATE CHARACTERISTICS IN CHEMICAL MECHANICAL PLANARIZATION

BACKGROUND OF THE INVENTION

1. Field of the Invention

This invention relates generally to chemical mechanical planarization, and more particularly to methods of and apparatus for improved edge performance in chemical mechanical planarization applications by configuring a platen to control removal rate characteristics.

2. Description of the Related Art

In the fabrication of semiconductor devices, there is a need to perform Chemical Mechanical Planarization (CMP) operations, including polishing, buffing and cleaning. Typically, integrated circuit devices are in the form of multi-level structures formed on an underlying substrate. In the manufacture of such devices, the substrate with one or more such structures may be referred to as a wafer. Such wafers may include a semiconductor or other substrate, and structures such as those described below. For example, structures such as transistor devices having diffusion regions may be formed on the substrate. In subsequent levels, other structures such as interconnect metallization lines may be patterned and electrically connected to the transistor devices to define the desired functional device. Patterned conductive layers are insulated from other conductive layers by dielectric materials, such as silicon dioxide.

As more metallization levels and associated dielectric layers are formed, there is an increased need to planarize the dielectric material of the wafer. Without planarization, fabrication of additional metallization layers becomes substantially more difficult due to variations in the surface topography. In other applications, additional structures such as metallization line patterns are formed in the dielectric material, and then metal CMP operations are performed to remove excess metallization. Further applications include planarization of dielectric films deposited prior to the metallization process, such as dielectrics used for shallow trench isolation of poly-metal features.

CMP systems typically implement an operation in which belts, pads, or brushes are used to scrub, buff, and polish one or both sides of the wafer. The pad itself is typically made of polyurethane material, and may be backed by a supporting belt, for example a stainless steel belt. In operation, a liquid slurry is applied to and spread across the surface of the polishing pad. The pad moves relative to the wafer, such as in a linear motion across the wafer, and the wafer is lowered to the surface of the pad and is polished.

In the past, CMP operations have been performed using an endless belt-type CMP system, in which the polishing pad is mounted on two rollers, which drive the polishing pad in a linear motion. The wafer is mounted on a carrier head, which is rotated on a vertical axis. The rotating wafer is urged against the polishing pad with a force that is referred to as a down force FD. The down force results in a polishing, or first, pressure applied to the surface of the wafer. To resist the force FD, and the resulting first pressure, a platen is provided under the polishing pad and is vertically aligned with the carrier head and with the downwardly urged wafer. The platen is configured to cause a force to be applied upwardly on the polishing pad, and to thus cause a counter pressure PUP to be applied under the polishing pad. The counter pressure PUP is vertically aligned with the carrier head and with the downwardly urged wafer to resist the down force FD and the resulting first pressure. Slurry, such as an aqueous solution of NH40H or DI water containing dispersed abrasive particles, is introduced to the polishing pad upstream of the wafer. The process of scrubbing, buffing and polishing of the surface is performed by the polishing pad and slurry urged against the exposed surface of the wafer.

For reference, the wafer is said to have a peripheral edge, which is an edge of a perimeter that extends circularly around the wafer. Inwardly of the peripheral edge, there is an outer annular surface of the wafer. In a pre-polishing condition of the wafer, this outer annular surface may have an excessive and variable material thickness. This outer annular surface extends 360 degrees around the circumference of the wafer, and has a width that varies from tool-to-tool and process-to-process. Such width is radially symmetric and may have a value of from about 3 mm to about 45 mm, for an exemplary 300 mm wafer. For reference, the outer annular wafer surface has a portion referred to as a "leading" wafer surface portion (LWSP), which is adjacent to an intersection of a radius of the wafer and the peripheral edge of the wafer when such radius is parallel to the linear direction of the belt-type polishing pad during polishing. Because the wafer surface rotates clockwise during that linear polishing pad movement, successive portions of the outer annular wafer surface are the "leading" wafer surface portions LWSP at successive moments during such wafer rotation. Similarly, when one portion of the outer annular surface (that was an LWSP) has rotated 180 degrees from the location at which it was the LWSP, this former LWSP is now referred to as the "trailing" wafer surface portion (TWSP). Again, successive portions of the outer annular wafer surface are the "trailing" wafer surface portion TWSP at successive moments during such wafer rotation. For reference, the platen is also said to have a leading surface, or edge, LE, and a trailing surface, or edge, TE. The platen LE is adjacent to an intersection of the radius of the wafer (when that radius is parallel to the linear direction of the belt-type polishing pad during polishing) and a surface of the platen that is first under the linearly moving polishing pad. The platen TE is adjacent to an intersection of the radius of the wafer (when that radius is parallel to the linear direction of the belt-type polishing pad during polishing) and a surface of the platen that is last under the linearly moving polishing pad. The radial widths of the leading edge LE and trailing edge TE are not well-defined, but it is understood that such widths are less than or equal to the respective widths of the leading wafer surface portion LWSP and the trailing wafer edge portion TWSP.

Ideally, in a pre-CMP polishing condition, to-be-polished wafers are relatively flat. However, in many cases, the material profile of a to-be-processed wafer is not flat and as a consequence, excess material must be removed from some portions of the wafer. For example, if there is a need to remove such excess material from adjacent to the wafer peripheral edge, e.g., from the outer annular wafer surface, reference may be made to a "fast edge" process. Ideally, the fast edge process polishes the outer annular surface at a higher rate than that used to polish another portion of the wafer surface that does not have the excess material, for example. The many different rates of material removal from the same wafer ideally conform to a desired "material removal profile". In this manner, and again ideally, the post-CMP processed wafer may have the desired degree of flatness.

In the past, to achieve the desired material removal profile, efforts have been made to provide the platen with fluid supply holes. The supplied fluid is generally air, and may be of many types, such as dry clean air. Reference is made herein to "fluid", which includes such air. It is to be understood that other suitable fluids are included in the term "fluid". In one such platen, these holes were arranged to define an outer group of concentric circular rings and multiple inner, groups of concentric circular rings, all of which were centered on the center of the platen, which is concentric with the central axis of the wafer. However, the fluid from these holes was not constrained. This lack of fluid constraint resulted in unacceptably high fluid usage. Furthermore, such platen was not fully amenable for use with all types of polishing belts. Specifically, results achieved with a flexible polishing belt were inferior to those achieved with a non-flexible belt.

Further efforts were made to reduce fluid usage and allow for the use of all types of polishing belts. A modified platen used a raised surface, hereafter referred to as a shim, in an effort to both restrict fluid usage and allow tuning of the material removal profile using either flexible or non-flexible polishing belts. The shim and a main platen surface cooperated with the polishing pad above the platen to define a fixed air pressure cavity. While this cooperation reduced the amount of air flowing from the chamber during CMP operations, difficulties were experienced in employing this platen configuration for achieving all polishing profile shapes, which are desirable to an end user. For example, in many instances, the pressure PUP within the cavity defined by the shim, the platen surface and the polishing belt, is largely constant. As a result of this largely constant pressure PUP, the material removal rate can also be largely constant. This largely constant material removal rate may be understood in terms of a characteristic of a curve that defines the removal rate of such described modified platen. Such a characteristic is that the constant removal rate is generally at a location around the center of the wafer. However, at a radial location, which corresponds to a region adjacent to the inner radius of the shim, that curve has an inflection point at which the relatively constant removal rate (due to the fixed-pressure in the cavity) suddenly changes. Thus, in the described modified platen, although there is a large area of uniform material removal surrounding the center of the wafer, the location of the inflection point is very closely adjacent to the peripheral edge of the wafer. The dimensions of the low pressure cavity of such modified platen are fixed in that the dimensions of the shim, the belt, and the platen are fixed, and such dimensions fix the size of the cavity. In this fixed dimension situation, once this modified platen is installed for CMP operations, it is not possible to significantly change the location of this inflection point. One unacceptable way of modifying the location of the inflection point would be to use shims that are adjustable to provide different shim diameters or shim widths. However, disadvantages of manufacturing cost and difficulties in use restrict the implementation of such an unacceptable configuration.

In review, to accommodate performing a removal of material that leaves a uniform surface of the wafer after the CMP operation, there is a need for an improved platen. This improved platen should reduce the amount of air that escapes from beneath the polishing pad in a manner which enables use of available low-cost polishing pads, and should provide an ability to position the inflection point at variable radial locations from the center of the platen during CMP operations. Further, the improved platen should be capable of achieving all of the material removal profiles that are desirable to an end user.

SUMMARY OF THE INVENTION

Broadly speaking, the present invention provides methods of and a platen for controlling a removal rate characteristic in chemical mechanical planarization operations. This control is achieved while allowing a low-cost polishing pad to be used, and while reducing the amount of fluid used to support the polishing pad, and while providing the "fast edge" operation as described above. One aspect of the platen configuration provides fluid pressure control to reduce leakage of fluid from beneath the polishing pad. A related aspect of the configuration contributes to control of removal rate characteristic parameters by locating an inflection point of the removal rate characteristic at variable locations. Another related aspect of the configuration controls one of such parameters by properly shaping a section of the removal rate characteristic during the fast edge operation, i.e., shaping a section between this location of the inflection point and the peripheral edge of the wafer.

One embodiment of the present invention relates to a platen for chemical mechanical planarization (CMP) of a wafer having a disk-like configuration. A platen body is configured with a leading edge and a main surface in a disk-like configuration corresponding to that of the wafer and extending from adjacent to the leading edge along a radius to a center of the disk-like configuration of the main surface. The platen body also has a shim configured with an outer circular raised wall surrounding the disk-like configuration of the main surface to define a cavity. The shim is further configured so that during a CMP operation the wafer peripheral edge is vertically aligned with the outer raised wall. The shim is further configured with an inner circular raised wall. The platen body is further configured with a cluster of fluid inlets surrounded by the inner wall and positioned adjacent to both the leading edge and the inner shim wall. The cluster is located adjacent to the radius and the main surface is continuous within the inner shim wall and around the fluid inlets.

In a related embodiment, the platen has a removal rate characteristic during the CMP operation, the removal rate characteristic being a variation of a rate of material removed from the wafer as a function of location along a polished surface of the wafer. The characteristic includes an inflection point at which a relatively constant removal rate suddenly changes to an increased removal rate adjacent to the wafer peripheral edge. The configuration of the platen body positions the cluster of fluid inlets relative to the inner wall so that the inflection point is located at a predetermined location relative to the wafer peripheral edge.

A still related embodiment includes the platen having the aforementioned removal rate characteristic. Here, the platen body is further configured to control values of the increased removal rate as a function of distance between the inflection point and the wafer peripheral edge. The further configuration is including a plurality of fluid inlets spaced from each other in a closely-packed group and configured within the group to control values of the increased removal rate between the modified inflection point and the wafer peripheral edge.

Another related embodiment includes the configuration of the cluster of fluid inlets within the closely-packed group as one of a series of concentric circles centered on the radius, a series of fluid inlets arranged along an arc extending generally parallel to the inner wall of the shim, and an array of fluid inlets arranged along each of a plurality of arcs that extend generally parallel to the inner wall of the shim, wherein each of the arcs is centered on the radius. The plurality of arcs may be configured with a first arc closely adjacent to the inner shim wall and with at least one additional arc spaced from the first arc toward the center. The fluid inlets along the first arc are more closely spaced than the fluid inlets along the additional arc. The plurality of arcs may include a second and a third arc, wherein the second arc is spaced from the first arc toward the center. The third arc may be spaced from the second arc toward the center, and the fluid inlets along the first arc may be more closely spaced than the fluid inlets along the second arc. The fluid inlets along the second arc may be more closely spaced than the fluid inlets along the third arc.

Another related embodiment may be provided in which the platen body is configured to control values of the increased removal rate at desired locations. The further configuration is by providing a second cluster of fluid inlets closely adjacent to the first-described cluster. The platen body configuration to control the values includes a configuration of the fluid inlets of the first and second clusters of fluid inlets relative to the inner wall of the shim. Each of the first and second clusters of fluid inlets includes a plurality of fluid inlets spaced from each other in a closely-packed group, wherein each closely-packed group is configured within the group and relative to the other group to control the values of the increased removal rate at desired locations.

Another embodiment of the present invention relates to a platen for chemical mechanical planarization (CMP) of a wafer having a disk-like configuration. A platen body is configured with a leading edge LE, and with a main surface comprising a disk-like configuration corresponding to that of the wafer and extending from adjacent to the LE along a first radius to a center of the disk-like configuration of the main surface and along a second radius to a trailing edge TE. The platen body also has a shim configured with an inner shim wall surrounding the disk-like configuration of the main surface to define a cavity. The shim is further configured with an outer shim wall that during a CMP operation is vertically aligned with a peripheral edge of the wafer. A third radius extends from the center at a first angle with respect to the second radius and extends to the inner shim wall. A fourth radius extends from the center at a second angle with respect to the second radius and extends to the inner shim wall. The platen body is further configured with a first cluster of fluid inlets located adjacent to both the leading edge and the first radius. The platen body is further configured with a second cluster of fluid inlets located adjacent to both the trailing edge and the third radius. The platen body is further configured with a third cluster of fluid inlets located adjacent to both the trailing edge and the fourth radius. The main surface is continuous within the inner shim wall and around all of the clusters of fluid inlets.

A still other embodiment of the present invention relates to a platen for supporting a polishing pad in CMP operations performed on a wafer having a peripheral edge. The platen includes a platen body configured with a relatively flat upper surface and a leading edge. An annularly-shaped shim has an inner shim wall and an outer shim wall. The shim is secured to and extends above the relatively flat upper surface to define a central wafer support bounded by the outer shim wall. The shim is configured to conform to the wafer by being configured with an outer shim wall diameter corresponding to a diameter of the wafer. Separate inner and outer clusters of air inlet holes extend through the flat upper surface at respective inner and outer cluster locations on the platen body. The cluster locations are within the central wafer support and the flat upper surface is continuous within the central wafer support and around the respective outer and inner clusters. The outer cluster location is closely adjacent to the inner shim wall and adjacent to the leading edge. The inner cluster location is between the outer cluster location and a center of the central wafer support and is closely adjacent to the outer cluster location. The inner cluster location is configured to position an inflection point at a selected location adjacent to the peripheral edge. The respective fluid inlets of the respective inner and outer clusters of fluid inlets are configured to provide a desired shape of the removal rate between the inflection point and the peripheral edge according to a ratio of a first pressure to a second pressure. The first pressure is a pressure of fluid applied to the air inlet holes of the respective outer cluster. The second pressure is a pressure of fluid applied to the air inlet holes of the respective inner cluster. The first and second pressures are separately applied to the respective air inlet holes of the respective outer and inner clusters.

A further embodiment of the present invention relates to a platen in which each of the outer and inner clusters of air inlet holes includes a plurality of air inlet holes. The air inlet holes of one cluster are spaced from each other in a closely-packed group and configured within the group to respond to the respective first and second pressures to control values of the increased removal rate between the inflection point and the peripheral edge. The configuration of each closely-spaced group of air inlets within the respective closely-packed group is one of a first series of air inlets arranged along concentric circles centered on the radius, a second series of air inlets arranged along an arc extending generally parallel to the inner wall of the shim, and a third series of air inlets arranged along each of a plurality of arcs that extend generally parallel to the inner wall of the shim, wherein each of the arcs of the third series is centered on the radius and those arcs are located at progressively greater distances from the inner shim wall.

A method embodiment of the present invention controls pressure beneath a polishing pad in a CMP operation to define desired parameters of a CMP removal rate characteristic. The method may include an operation of defining an enclosed volume under the polishing pad at a location at which a wafer is to be urged onto the polishing pad. The enclosed volume has a continuous perimeter corresponding to a peripheral edge of the wafer to provide a polishing pad support aligned with the peripheral edge of the wafer. Another operation urges the wafer against the polishing pad under the action of a first pressure to urge a leading surface portion of the wafer against the polishing pad. Another operation directs a first cluster of controlled flows of fluid into the enclosed fluid volume at a second pressure that exceeds the first pressure. The controlled flows are directed at selected discrete first locations and adjacent to the continuous perimeter and in opposition to the leading surface portion of the wafer. The discrete first locations are selected to provide one of the desired parameters of the removal rate characteristic.

A related aspect of the described method is that the discrete first locations are selected with respect to an inflection point as one of the desired parameters of the removal rate characteristic. The discrete first locations are selected to position the inflection point at a predetermined location adjacent to the peripheral edge.

Another related aspect of the described method is a further operation of directing a second cluster of controlled flows of fluid into the enclosed fluid volume at a third pressure with a sum of the second and third pressures exceeding the first pressure. The second cluster of controlled flows is directed at selected discrete second locations between the selected discrete first locations and the continuous perimeter. Another operation may control the second and third pressures so that with the sum of the second and third pressures exceeding the first pressure, the third pressure and the second pressure are in a ratio having a value exceeding one to provide a selected given shape of the CMP removal rate characteristic between the inflection point and the peripheral edge of the wafer. The operations of directing the first and second clusters of controlled flows may include controlling amounts of the respective flows of the respective first and second clusters so that an amount of fluid directed into the volume varies with the distance of a particular one of the fluid flows from the continuous perimeter. The variation is to direct into the volume progressively more air from the fluid flows as the fluid flows are positioned closer and closer to the continuous perimeter.

BRIEF DESCRIPTION OF THE DRAWINGS

The accompanying drawings, which are incorporated in and constitute part of this specification, illustrate exemplary embodiments of the present invention and together with the description serve to explain the principles of the present invention.

DETAILED DESCRIPTION OF THE INVENTION

Several exemplary embodiments of the invention will now be described in detail with reference to the accompanying drawings. In the following description, numerous specific details are set forth in order to provide a thorough understanding of the present invention. It will be understood, however, to one skilled in the art, that the present invention may be practiced without some or all of these specific details. In other instances, well known process operations have not been described in detail in order not to obscure the present invention.

Figure 1:
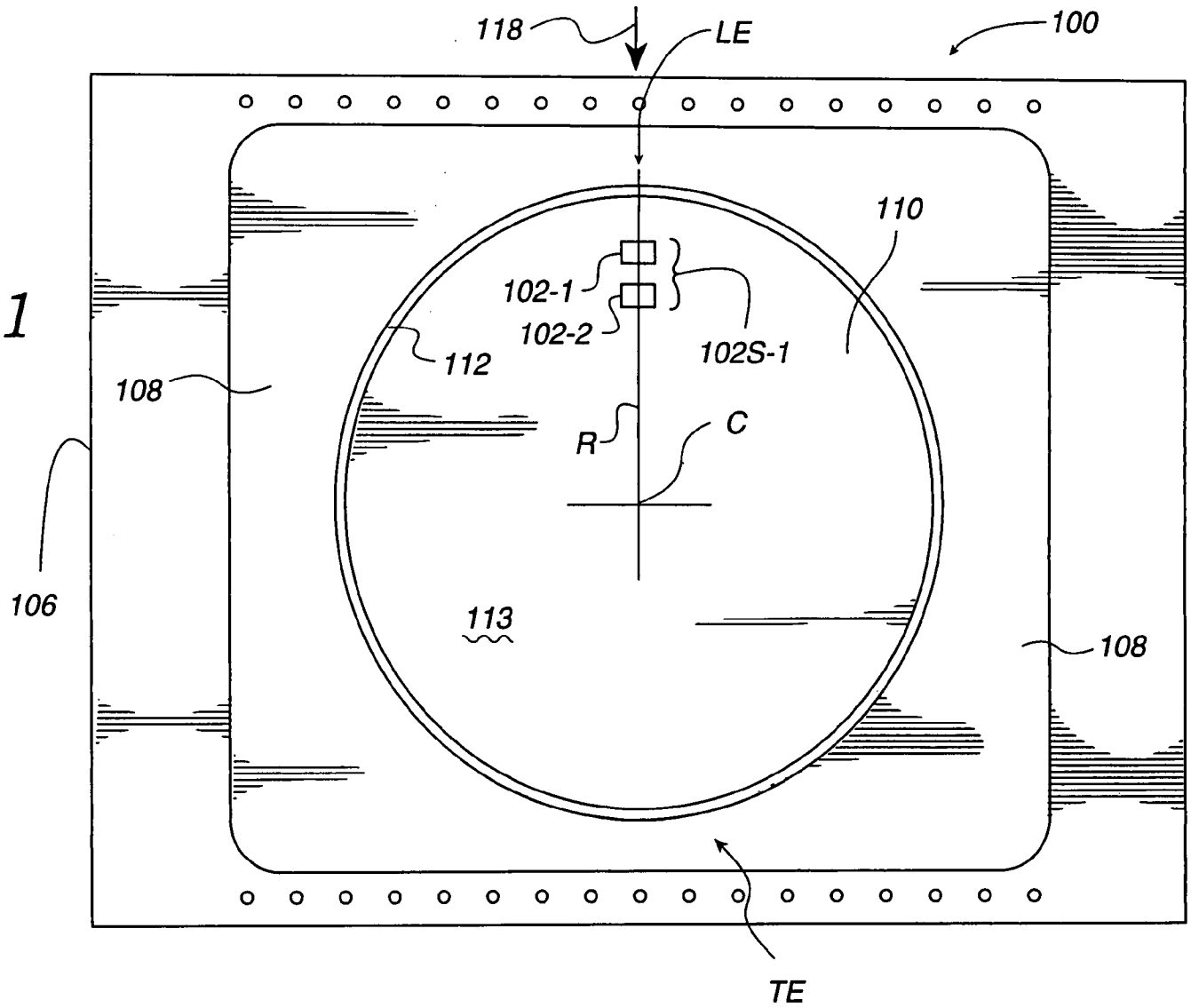
FIG. 1 is a plan view of a platen of one embodiment of the present invention, showing the platen provided with one set of clusters of fluid inlets.
Figure 4:
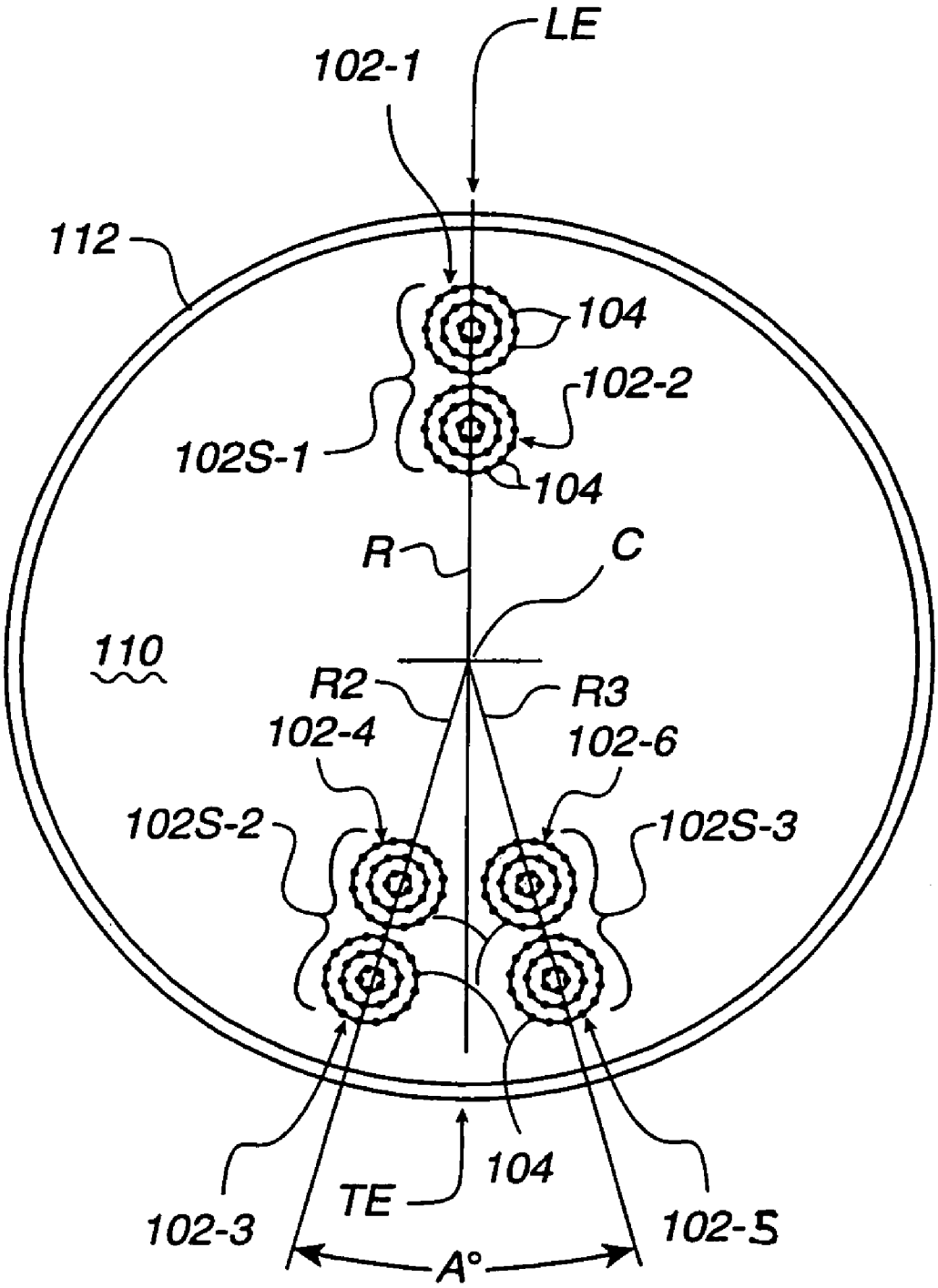
FIG. 4 is a plan view of the platen of another embodiment of the present invention, showing a shim surrounding six clusters of fluid inlets.

FIG. 1 is a plan view of a platen 100 of one embodiment of the present invention, in which the platen is provided with a first cluster 102-1 of fluid inlets 104 (FIG. 4). The platen 100 is configured for chemical mechanical planarization (CMP) of a wafer (not shown), the wafer having a disk-like configuration. A generally rectangular platen body 106 is configured with a leading edge LE and a main surface 108 that is planar, or flat. A central section 110 having a disk-like configuration is provided on the main surface 108. The central section 110 is shaped to correspond to the shape of the wafer and extends inwardly to the center from the entire perimeter of a circular raised surface at the periphery of the central section, which surface is referred to as a shim 112. The central section 110 may be defined within the shim 112, which surrounds a portion (the central section 110) of the main surface 108. The raised shim 112 extends upwardly from the main surface 108 and has a height above the main surface 108 of from about four to about six mm, for example. The shim 112 and the central section 110 within the shim define an open top cavity, or chamber, 113. The platen body 106 is further configured with the first cluster 102-1 of the fluid inlets 104. The first cluster 102-1 is adjacent to the leading edge LE, and is more-closely adjacent to the shim 112. The first cluster 102-1 is shown located adjacent to the radius R. For descriptive purposes, the first cluster 102-1 is shown generally as an enclosure to indicate that any one of many cluster embodiments described below may be used for the first cluster 102-1. The central section 110 is shown being continuous within the shim 112 and around the cluster 102-1 of the fluid inlets 104. In detail, the central section 110 is uninterrupted by any fluid hole, except for the fluid inlets 104 of the first cluster 102-1, and except for fluid inlets 104 of a second cluster 102-2. As a result, fluid is directed into the chamber 113 only from the fluid inlets 104 of the clusters 102-1 and 102-2. Stated differently, the continuous section 110 does not allow any fluid to enter the chamber 113 from other than the fluid inlets 104 of the clusters 102-1 and 102-2.

The second cluster 102-2 is also shown generally as an enclosure to indicate that any one of many cluster embodiments described below may be used for the second cluster 102-2. The platen body 106 is further configured with the second cluster 102-2, which is located between the first cluster 102-1 and the center C of the central section 110. For ease of description, the configuration of the first and second clusters 102-1 and 102-2 may be referred to as a set of clusters 102S, and these clusters 102-1 and 102-2 are of a first set 102S-1.

Figure 2:
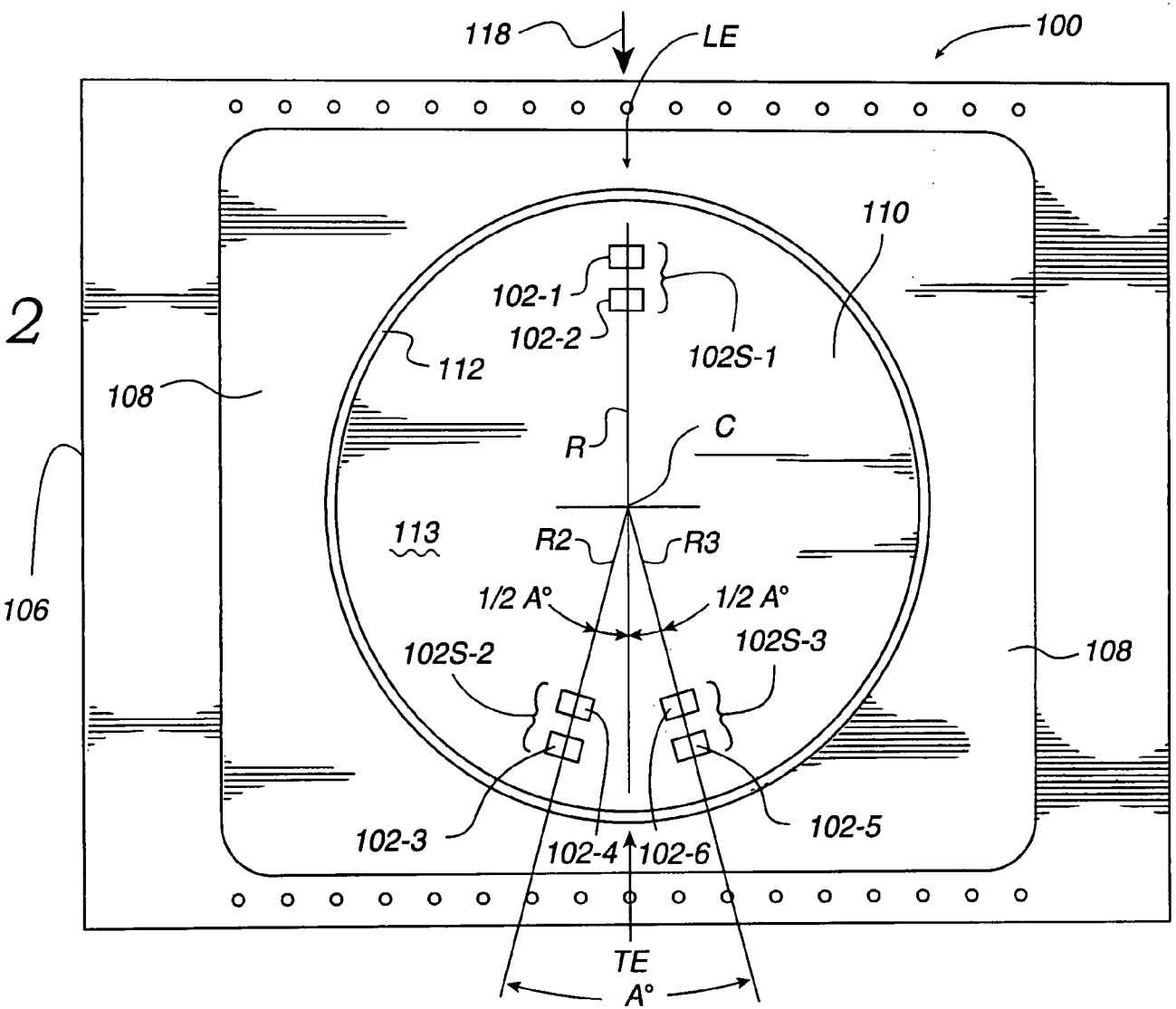
FIG. 2 is a plan view of the platen of another embodiment of the present invention, showing the platen provided with second and third sets of clusters of fluid inlets and with the first set of clusters of fluid inlets.

FIG. 2 is a plan view of another embodiment of the platen 100, in which the platen is provided with the generally rectangular platen body 106 configured with the leading edge LE, the main surface 108, the shim 112 around the central section 110, and the first set of clusters 102S-1. The configurations of the first set 102S-1, and the relationship thereof relative to the shim 112 and the leading edge LE, are as described above. The embodiment of FIG. 2 also includes a second set 102S-2, and a third set 102S-3, of the clusters 102 of fluid inlets 104. These respective sets 102S-2 and 102S-3 are located on the central section 110 generally opposite to the first set 102S-1. More specifically, a trailing edge TE of the platen 100 is shown opposite to the leading edge LE, and an area within an arc A of about 30 to about 120 degrees on each side of the trailing edge TE may be defined within the shim 112. Thus, the trailing edge TE is generally at such area, and is a location of the second and third sets 102S-2 and 102S-3. More specifically, each of the second and third sets 102S-2 and 102S-3 may be located adjacent to the shim 112 and adjacent to a respective radius R2 and R3 from the center C. The platen body 106 is further configured with the second set 102S-2 having a third cluster 102-3 adjacent to the trailing edge TE and more closely adjacent to the shim 112, and with a fourth cluster 102-4 located between the third cluster 102-3 and the center C of the central section 110. The platen body 106 is further configured with the third set 102S-3 having a fifth cluster 102-5 adjacent to the trailing edge TE and more closely adjacent to the shim 112, and with a sixth cluster 102-6 located between the fifth cluster 102-5 and the center C of the central section 110. Again, FIG. 2 shows the central section 110 being continuous within the shim 112 in that the central section 110 is uninterrupted by any fluid hole, except for the fluid inlets 104 of the first cluster 102-1, and except for fluid inlets 104 of the first set 102-1, of the second set 102S-2, and of the third set 102S-3.

Figure 3:
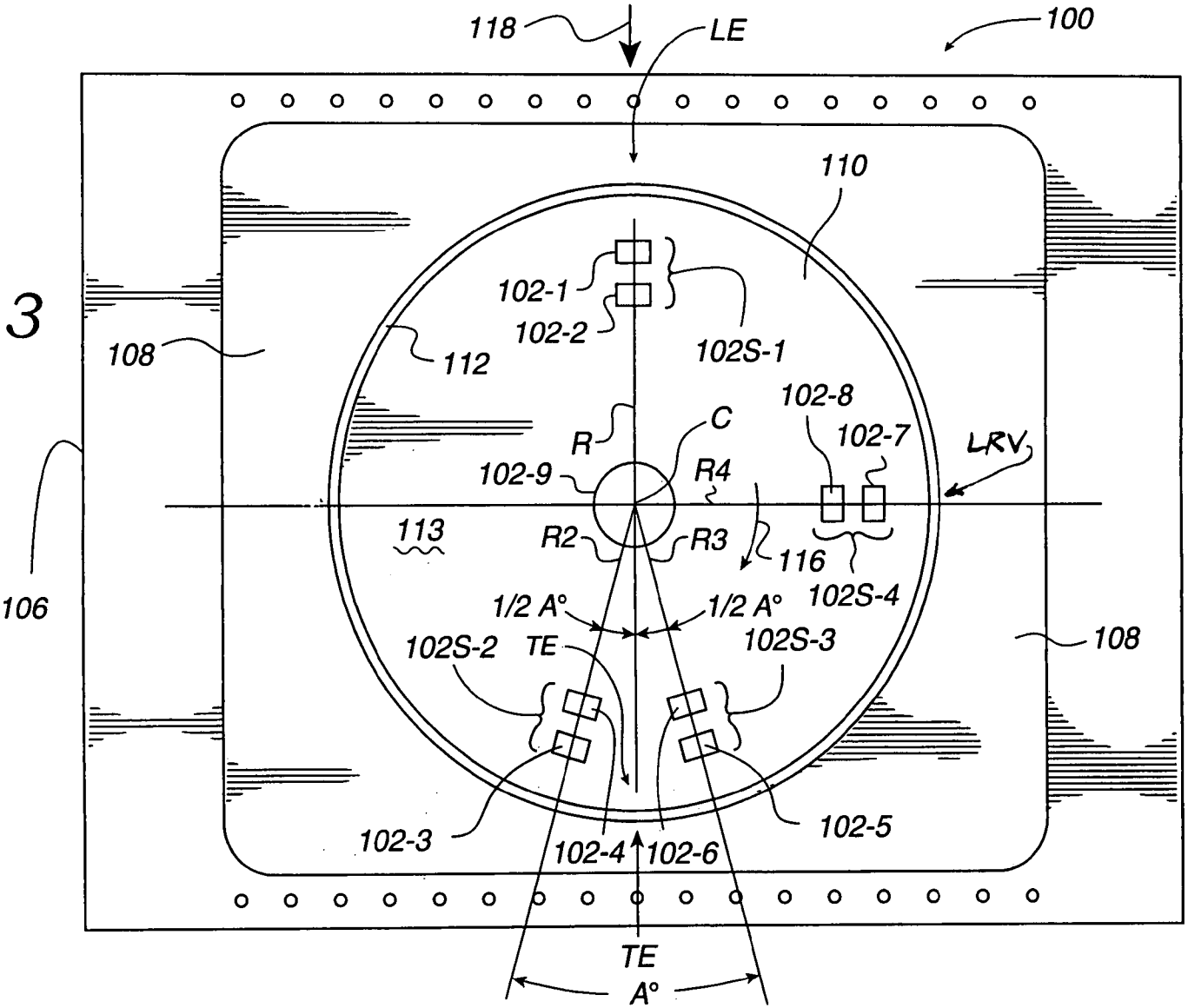
FIG. 3 is a plan view of the platen of another embodiment of the present invention, showing the platen provided with a fourth set of clusters of fluid inlets and with the first, second, and third sets of clusters of fluid inlets.

FIG. 3 is a plan view of another embodiment of the platen 100, in which the platen is provided with the generally rectangular platen body 106 configured with the leading edge LE, the main surface 108, the shim 112 and the respective first, second, and third sets 102S-1, 102S-2, and 102S-3, the configurations of which, and the relationship thereof relative to the shim 112 and the respective leading edge LE and trailing edge TE, are as described above. The embodiment of FIG. 3 is also described with respect to a side of the platen 100. A curved arrow 116 is shown to indicate a direction of rotation of the wafer (not shown in FIG. 3, see FIG. 7A) during the CMP operations. A straight arrow 118 is also shown to indicate a lineal direction of motion of a polishing pad (not shown in FIG. 3, see FIG. 6A) during the CMP operations. The platen 100 is stationary during these operations. A side LRV of the platen is underneath that portion the wafer that is moving downward (arrow 116) in FIG. 3 and is underneath that portion of the polishing pad that is moving downward (arrow 118) in FIG. 3. LRV indicates "Low Relative Velocity". It may be understood that the teachings of the present invention include a recognition that in use the polishing pad (not shown) may become smoothed at the LRV location at which this low relative velocity exists between the polishing pad and the wafer. A fourth radius R4 extends from the center C to the side LRV. The embodiment of FIG. 3 also includes a fourth set 102S-4 of the clusters 102 of fluid inlets 104. This fourth set 102S-4 is also located on the central section 110 generally between the first set 102S-1 and the third set 102S-3. The radius R4 generally defines the location of the fourth set 102-4. More specifically, the fourth set 102-4 may be located along (or adjacent to) the radius R4, adjacent to the shim 112, and adjacent to the edge LRV. The platen body 106 is further configured with the fourth set 102S-4 having a seventh cluster 102-7 adjacent to the edge LRV and more closely adjacent to the shim 112. The set 102S-4 has an eighth cluster 102-8 located between the seventh cluster 102-7 and the center C of the central section 110. Again, FIG. 3 shows the central section 110 being continuous within the shim 112 as described above with respect to FIG. 2 and the sets 102S-1 and 102S-3, for example, and with the further exception of only the fluid holes 104 of the clusters 102-7 and 102-8, and of a ninth cluster 102-9 centered on the center C of the central section 110 of the platen body 106. Each of the seventh and eighth respective clusters 102-7 and 102-8 is also shown generally as an enclosure to indicate that any one of many cluster embodiments described below may be used for these clusters. The ninth cluster 102-9 may correspond to the embodiment shown in more detail in FIG. 5A below.

In the above descriptions, the first cluster 102-1 was said to be adjacent to the leading edge LE and "more-closely" adjacent to the shim 112. Similarly, the platen body 106 was said to be further configured with the third cluster 102-3 adjacent to the trailing edge TE and "more-closely" adjacent to the shim 112. Similarly, the platen body 106 was said to be further configured with the fifth cluster 102-5 adjacent to the trailing edge TE and "more closely" adjacent to the shim 112. Similarly, the platen body 106 was said to be further configured with the seventh cluster 102-7 adjacent to the edge LRV and "more closely" adjacent to the shim 112. In each case, and in one sense, the reference to "more closely" indicates that the shim 112 is between the particular cluster 102 and the respective leading edge LE or trailing edge TE. Further, and in another sense, the reference to "more closely" indicates that the particular cluster 102 is located closer to the shim 112 than to the respective leading or trailing edge. Still further, and in yet another sense, the reference to "more closely" indicates that the particular cluster 102 is located in a range of about 10 mils to about 125 mils from the shim 112, with that distance being from the shim 112 to the fluid inlet 104 that is closest to the shim 112. The distance of 10 mils represents an approximate limit of closest proximity of such fluid inlet 104 to the shim 112, which limit is said to be approximate because of minor variations in machining tolerances required for drilling, for example, such inlets 104 as close as possible to the shim 112.

FIG. 4 is a plan view of another embodiment of the platen 100, in which the rectangular platen body 106 is not shown and the central section 110 is enlarged to show an exemplary embodiment of the clusters 102 of fluid inlets 104. In FIG. 4, the enclosure shown in each of FIGS. 1, 2 and 3 is not shown and instead, the details of this cluster embodiment are shown. FIG. 4 shows the first set 102S-1 as including one cluster 102-1 configured from an array of fluid inlets 104. The array of the one cluster 102-1 is shown including an exemplary three concentric reference circles. Each circle forms a portion of a center (or reference) line of a plurality of equally-spaced fluid inlets 104. The inner reference circle may, for example, be about 0.75 inches in diameter and 12 fluid inlets 104 may be located equally-spaced around the inner reference circle. The next outer reference circle may, for example, be about 1.0 inches in diameter and 16 fluid inlets 104 may be located equally-spaced around the inner reference circle. The outer reference circle may, for example, be about 1.25 inches in diameter and 27 fluid inlets 104 may be located equally-spaced around the inner reference circle. These exemplary numbers of inlets 104 are not shown in the Figures due to space limitations. One fluid inlet 104 is shown on the outer reference circle aligned with the radius R and closest to the shim 112. That one fluid inlet 104 is the above-referenced fluid inlet 104 that is located in the range of about 10 mils to about 125 mils from the shim 112. It may be understood that the portion of the outer reference circle nearest to the shim 112, and the fluid inlets 104 on that portion are most closely adjacent to the leading edge LE and to the shim 112. As a variation of the configuration of the fluid inlets 104 shown in FIG. 4, the diameters of the respective fluid inlets 104, and the numbers of such inlets around any one reference circle, may be different from that shown, such that a greater volume of fluid may exit the fluid inlets 104 that are closer to the shim 112 than the volume that exits from the inlets 104 that are closer to the center C.

FIG. 4 also shows the second cluster 102-2 of the first set 102S-1, also configured as an array of fluid inlets 104. The array of the second cluster 102-2 is also shown configured in reference to an exemplary three concentric reference circles, with each circle forming a portion of a center line of a plurality of fluid inlets 104. In one embodiment of the present invention, and in a manner similar to the first cluster 102-1, the diameters of the reference circles and the numbers of inlets 104 around each reference circle may be the same as described with respect to the first cluster 102-1. Alternatively, in another embodiment of the present invention, the diameters of the reference circles of the cluster 102-2 may be less than that described with respect to the first cluster 102-1, and fewer inlets 104 may be on each reference circle of the cluster 102-2. In this manner, the configuration of the fluid inlets around the circles, and the diameters of the respective fluid inlets 104 of the respective clusters 102-1 and 102-2 may be such that a greater aggregate volume of fluid may exit the fluid inlets 104 of the first cluster 102-1 than the aggregate fluid volume that exits the fluid inlets 104 of the second cluster 102-2. Alternatively, in a further embodiment of the present invention, the similarity of the respective first and second clusters 102-1 and 102-2 may also be modified such that the fluid inlets may be unevenly spaced around each of the reference circles of each of the clusters 102-1 and 102-2. Here, the uneven spacing results in a higher inlet fluid volume input to the chamber 113 for each portion of each reference circle as such portions are closer to the shim 112. In this manner, the volume of fluid exiting the fluid inlets 104 may decrease from a greater volume nearer to the shim 112 and progressively diminish as the fluid inlets are closer to the center C.

In another embodiment of the present invention, the fluid inlets 104 of the set 102S-1 of clusters 102 may have a diameter of from about 10 mils to about 60 mils, with the diameter being in a more preferred range being from about 15 mils to about 30 mils, and a most preferred diameter being about 20 mils.

The second and third sets 102S-2 and 102S-3 may be configured in a manner similar to that described above with respect to the set 102S-1 of clusters.

It may be understood from the above descriptions of the reference circles and inlets 104 organized along such reference circles, that each cluster 102 of fluid inlets 104 is configured with a plurality of the fluid inlets 104, and that such inlets 104 are spaced from each other in a closely-packed group represented by the identification "cluster". Further, each such cluster 102 may be configured within each such closely-packed group to control values of the volume of the fluid admitted into the chamber 113 at various locations along the radius R. As one example, those locations may correspond to the respective locations of the inlets 104 of each separate cluster 102. A pressure applied to the inlets 104 of the outer, or first, cluster 102-1 may be P1 and be higher than a pressure P2 applied to the inlets 104 of the inner, or second, cluster 102-2. As a result, a greater volume of the fluid may be supplied to the chamber 113 from the outer cluster 102-1 than is supplied to the chamber 113 from the second, or inner, cluster 102-2. As another example, less difference in the pressures P1 and P2 would be required to have the same greater volume from the outer cluster 102-1 as compared to the volume from the inner cluster 102-2 by configuring the diameters of all or some of the inlets 104 of the outer cluster 102-1 larger than the diameters of the inlets 104 of the inner cluster 102-2. As a still further example, considering the radius R intersecting successive portions of the reference circles shown in FIG. 4, from close to the shim 112 toward the center C. If the spaces between the inlets 104 on the successive portions of the circles decrease as the radius R extends from the shim 112 to the center C, and if the diameters of the inlets on those circles is the same and the same pressure fluid is applied to each inlet 104 of both clusters 102-1 and 102-2, then the configuration of the clusters 102 by the spacing of the inlets 104 controls the values of the volume of the fluid admitted into the chamber 113 at the various locations along the radius R, and those locations correspond to the intersections of the radius R and the portions of the circles.

Figure 5A:
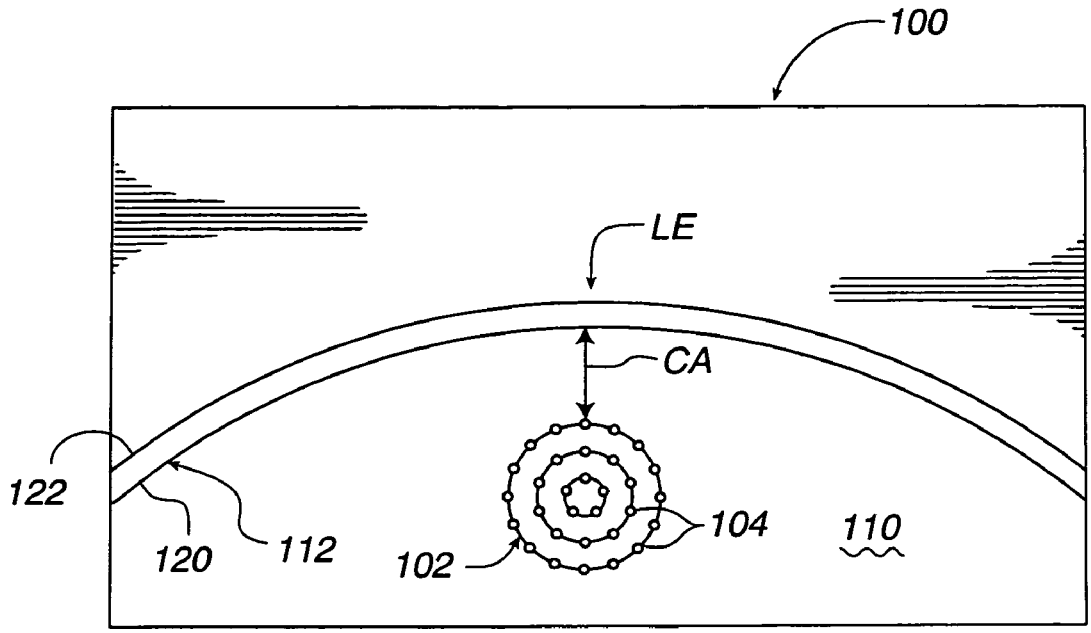
FIGS. 5A through 5D are a series of plan views of different clusters of fluid inlets, illustrating a proximity of the clusters to the shim.

FIG. 5A is an enlarged plan view of the outer, or first, cluster 102-1 of fluid inlets 104 shown in FIG. 4 (shown here as 102). The enclosure shown in FIGS. 1 through 3 is shown for reference purposes to orient the viewer. A portion of the shim 112 is shown. The shim 112 is shown configured with an inner wall 120 and an outer wall 122. The inner wall 120 and the outer wall 122 are configured to provide a thickness of the shim 112 in the direction of the radius R of about four mm. As described above, the one cluster 102 is shown more-closely adjacent to the shim 112, such as with the one inlet 104 being within the range of about 10 to 125 mils from the shim. The spacing of the one inlet 104 from the inner wall 120 of the shim 112 is indicated by the dimension CA. The cluster 102 is shown configured in relation to the exemplary three concentric reference circles, with each circle forming a portion of a center line of a plurality of the fluid inlets 104. The individual fluid inlets 104 are as shown in FIG. 4, or may be configured and spaced as described above with respect to FIG. 4. As described above, the central section 110 is shown in more detail in FIG. 5A as being continuous within the shim 112 and around the cluster 102 of the fluid inlets 104. Thus, in the example shown in FIG. 5A in which only the first cluster 102 is shown, FIG. 5A makes it clear that the central section 110 is uninterrupted by any fluid hole, except for the fluid inlets 104 of the first cluster 102. As a result, fluid is directed into the chamber 113 only from the fluid inlets 104 of the cluster 102 in this example. Stated differently, the continuous section 110 does not allow any fluid to enter the chamber 113 from other than the fluid inlets 104 of the exemplary cluster 102-1.

Figure 5B:
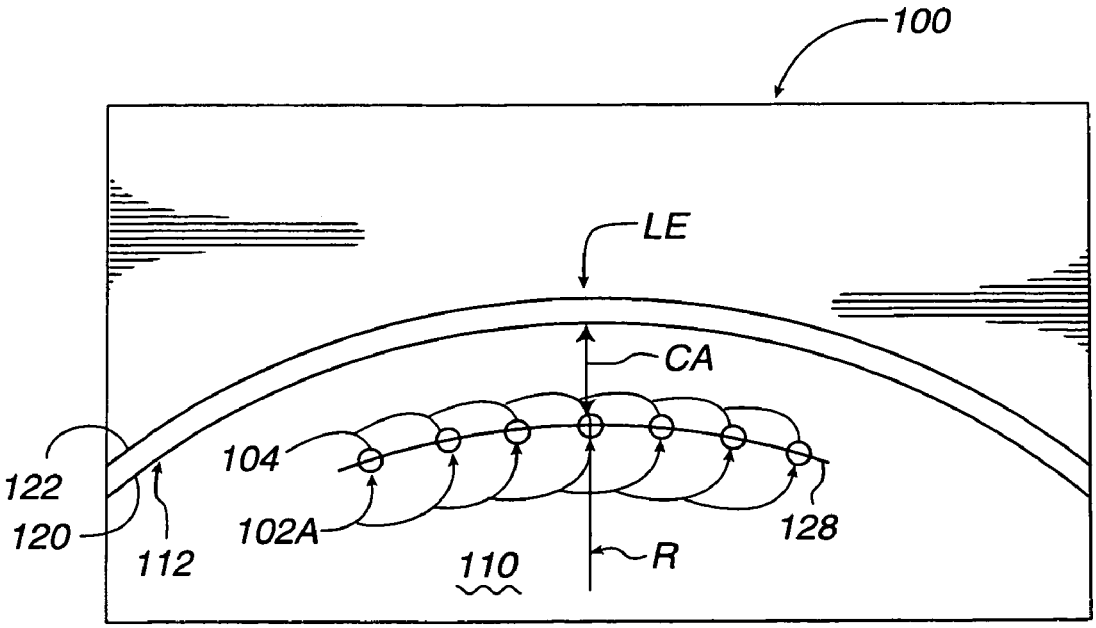

FIG. 5B is an enlarged plan view of another embodiment of a cluster 102 of fluid inlets 104. The enclosure shown in FIGS. 1 through 3 is shown for reference purposes to orient the viewer. As shown in FIG. 5A, a portion of the shim 112, the inner wall 120, and the outer wall 122, are shown. The cluster 102 is shown configured with respect to an exemplary single arcuate reference line 128, thus this cluster 102 is referred to as the "arc cluster" 102A. The reference line 128 extends parallel to the inner wall 120 of the shim 112. The cluster 102A is show adjacent to the leading edge LE of the platen body 108, and is shown more closely adjacent to the shim 112 (as defined above). This more closely adjacent spacing is shown by the one inlet 104 closest to the shim 112 and is indicated by the dimension CA. The individual fluid inlets 104 of the arc cluster 102A may be as shown in FIG. 5B, evenly spaced and may be in such number (shown as seven) as emits a desired volume of fluid into the chamber 113, i.e., the volume defined inside the shim 112. The arc cluster 102A may also be configured with more fluid inlets 104, such as from about ten to about seventy inlets 104, and the diameters of such inlets 104 may be in a range of from about ten mils to about sixty mils. Further, the length of the arcuate reference line 128 may be in a range of about ten degrees to about one hundred eighty degrees, and is preferably centered on the radius R. The individual fluid inlets 104 of the arc cluster 102A may also be spaced closer together at the leading edge with spacing increasing with increasing distance from the radius to the end of the arc of the arcuate reference line 128, and may be in such number as emits a desired volume of fluid into the chamber 113, i.e., the volume defined inside the shim 112.

Figure 5C:
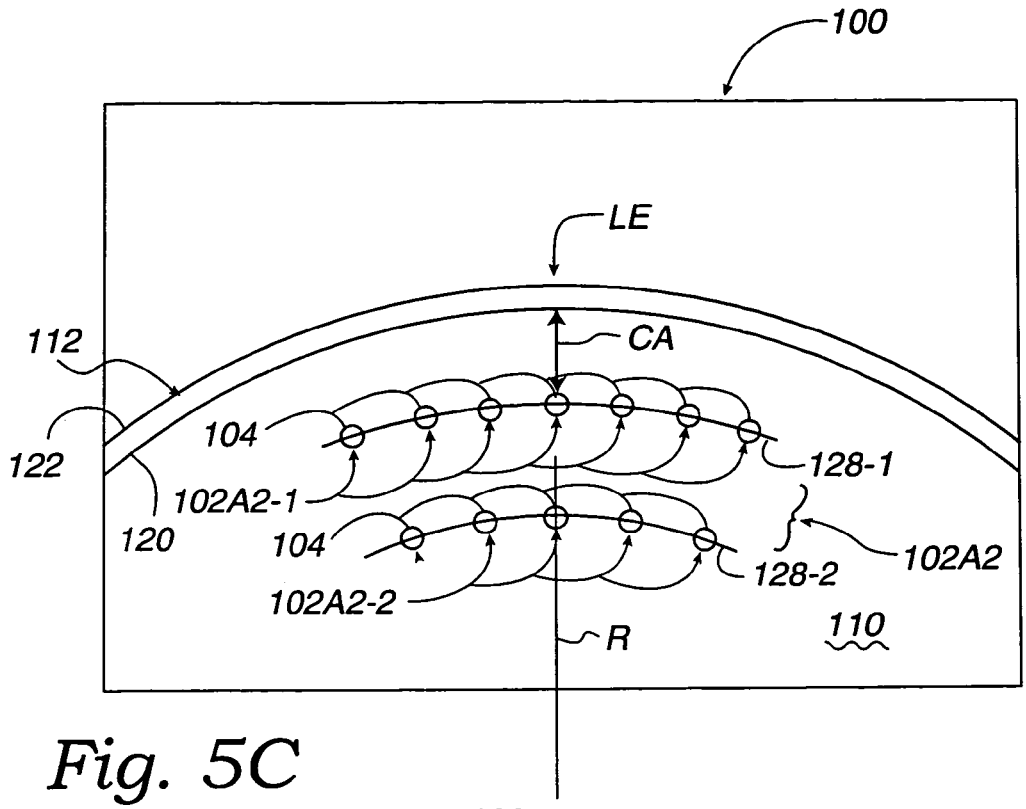

FIG. 5C is an enlarged plan view of a further embodiment of a cluster 102 of fluid inlets 104 of the type shown in FIG. 5B. As is also shown in FIGS. 5A and 5B, the enclosure is shown for reference purposes to orient the viewer and a portion of the shim 112, the inner wall 120, and the outer wall 122 are shown. This cluster 102 is configured with an exemplary two arc clusters 102A. To distinguish from the single arc cluster 102A, the cluster 102 of FIG. 5C is referred to as 102A2 to designate the configuration from the two exemplary arc clusters 102A. The cluster 102A2 is shown configured with respect to exemplary dual arcuate reference lines 128-1 and 128-2, each of which is parallel to the inner wall 120 of the shim 112. The reference line 128-1 references a first, or outer, arc portion 102A2-1 of the cluster 102A2. The outer arc portion 102A2-1 is show adjacent to the leading edge LE, and more closely adjacent to the shim 112 (as defined above) than an inner arc portion 102A2-2. This more closely adjacent spacing is shown by one inlet 104 of the outer arc portion 102A2-1 closest to the shim 112 and is indicated by the dimension CA. The individual fluid inlets 104 of the outer portion 102A2-1 may be as shown in FIG. 5B, evenly spaced from each other along the arcuate reference line 128-1, and may be in such number (shown as seven) as emits a desired volume of fluid into the chamber 113, i.e., the volume defined inside the shim 112.

The reference line 128-2 references a second, or inner, arc portion 102A2-2 of the cluster 102A2. The inner arc portion 102A2-2 is show adjacent to the leading edge LE, and is between the outer arc portion 102A2-1 and the center C (FIG. 1).

The individual fluid inlets 104 of the outer arc portion 102A2-1 may be as shown in FIG. 5B, evenly spaced from each other along the arcuate reference line 128-1, and may be in such number (shown as an exemplary seven) as emits a desired volume of fluid into the chamber 113. The arc portion 102A2-1 may also be configured with more fluid inlets 104, such as from about ten to about seventy inlets 104, and the diameters of such inlets 104 may be in a range of from about ten mils to about sixty mils. Further, the length of the arcuate reference line 128-1 may be in a range of about ten degrees to about one hundred eighty degrees, and is preferably centered on the radius R. The individual fluid inlets 104 of the inner arc portion 102A2-2 may be evenly spaced from each other along the arcuate reference line 128-2, and may be in such number (shown as an exemplary five) as emits a desired volume of fluid into the chamber 113. Such desired volumes emitted from the respective arc portions 102A2-1 and 102A2-2 may be selected in relation to each other, such that the volume emitted from the outer arc portion 102A2-1 may exceed the volume emitted from the inner arc portion 102A2-2, as is described more fully below with respect to FIG. 7D. The arc portion 102A2-2 may also be configured with more than five fluid inlets 104, such as from about 10 to about 60 inlets 104, and the diameters of such inlets 104 may be in a range of from about ten mils to about sixty mils. Further, the length of the arcuate reference line 128-1 may be in a range of about ten degrees to about one hundred eighty degrees, and is preferably centered on the radius R.

Figure 5D:
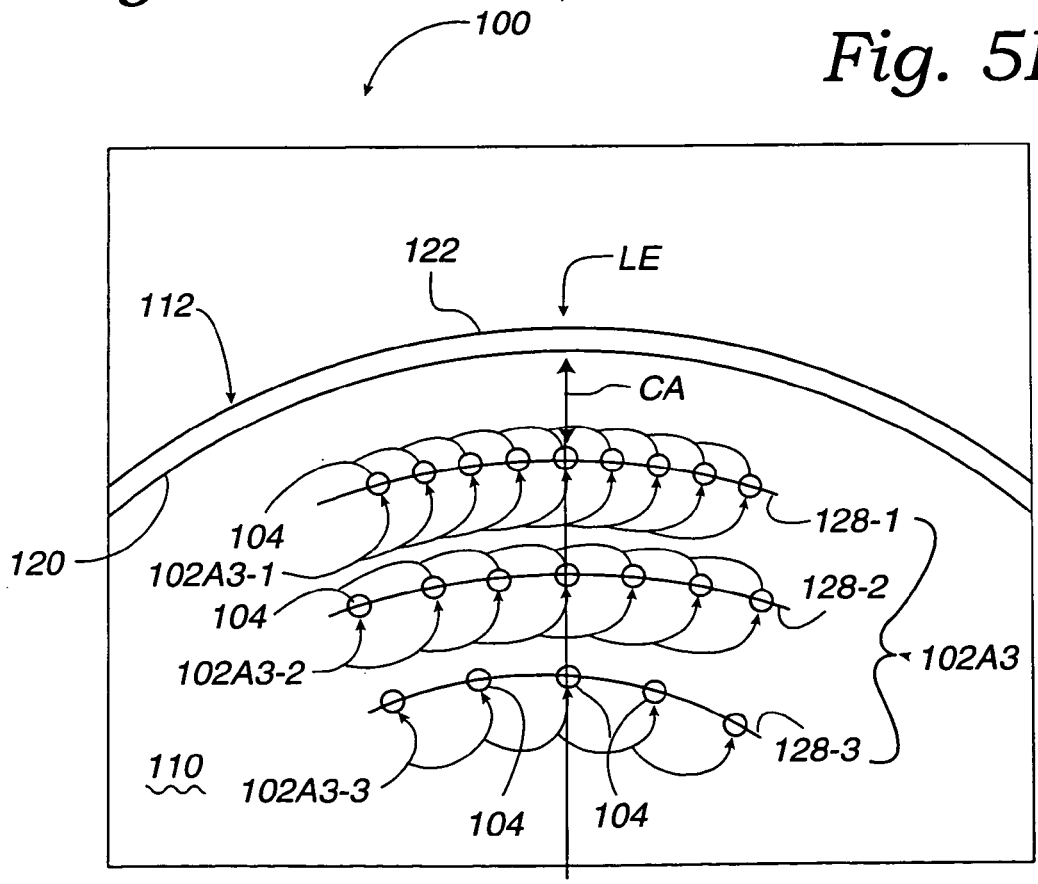

FIG. 5D is an enlarged plan view of a further embodiment of a cluster 102 of fluid inlets 104 of the type shown in FIGS. 5B and 5C. The enclosure is shown for reference purposes to orient the viewer and a portion of the shim 112, the inner wall 120, and the outer wall 122, are shown. This cluster 102 is configured with an exemplary three arc clusters 102A, it being understood that a plurality of arc clusters 102A greater than three may be used to configure this cluster 102. To distinguish from the dual arc cluster 102A2, the cluster 102 of FIG. 5D is referred to as "102A3" to designate the configuration from the three exemplary arc clusters 102A. The cluster 102A3 is shown configured with respect to exemplary arcuate reference lines 128-1, 128-2 and 128-3, each of which is parallel to the inner wall 120 of the shim 112. The reference line 128-1 references a first, or outer, arc portion 102A3-1 of the cluster 102A3. The outer arc portion 102A3-1 is show adjacent to the leading edge LE, and more closely adjacent to the shim 112 (as defined above) than a middle, or second, arc portion 102A3-2. This more closely adjacent spacing is shown by one inlet 104 of the outer arc portion 102A3-1 closest to the shim 112 and is indicated by the dimension CA. The individual fluid inlets 104 of the outer arc portion 102A3-1 may be as shown in FIG. 5B, evenly spaced from each other and may be in such number (shown as nine) as emits a desired volume of fluid into the chamber 113. This even spacing may be about 7 to 14 inlets 104 per inch of the reference line 128-1. The individual fluid inlets 104 of the outer arc portion 102A3-1 may be closer together at the radius with spacing increasing with increased distance from the radius towards the end of the arcuate reference line 128-1, and may be in such number as emits a desired volume of fluid into the chamber 113.

The reference line 128-2 references a second, or middle, arc portion 102A3-2 of the cluster 102A3. The middle arc portion 102A3-2 is shown adjacent to the leading edge LE, and is between the outer arc portion 102A3-1 and a third, or inner, arc portion 102A3-3 of the cluster 102A3. The third arc portion 102A3-3 is between the middle arc portion 102A3-2 and the center C (FIG. 1) and extends along the reference line 128-3.

The outer arc portion 102A3-1 may also be configured with more fluid inlets 104, such as from about ten to about seventy inlets 104, and the diameters of such inlets 104 may be in a range of from about ten mils to about sixty mils. Further, the length of the arcuate reference line 128-1 may be in a range of about ten degrees to about one hundred eighty degrees, and is preferably centered on the radius R.

The individual fluid inlets 104 of the middle arc portion 102A3-2 may be evenly spaced from each other along the arcuate reference line 128-2. This even spacing may be different from that of the spacing along the reference line 128-1, and generally is a greater spacing, such as about 5 to 12 inlets 104 per inch of the reference line 128-2. This number (shown as an exemplary seven) emits a desired volume of fluid into the chamber 113 in relation to the volume emitted from the outer arc portion 102A3-1. The middle arc portion 102A3-2 may also be configured with more than seven fluid inlets 104 and the diameters of such inlets 104 may be in a range of from about ten mils to about sixty mils. Further, the length of the arcuate reference line 128-2 may be in a range of about ten degrees to about one hundred eighty degrees, and is preferably centered on the radius R.

The individual fluid inlets 104 of the inner arc portion 102A3-3 may be evenly spaced from each other along the arcuate reference line 128-3. This even spacing may be different from that of the inlet spacing along the reference lines 128-1 and 128-2, and generally is a greater spacing, such as about 3 to 10 inlets 104 per inch of the reference line 128-3. This number (shown as an exemplary five) emits a desired volume of fluid into the chamber 113. The inner arc portion 102A3-3 may also be configured with more than five fluid inlets 104, and the diameters of such inlets 104 may be in a range of from about ten mils to about sixty mils. Further, the length of the arcuate reference line 128-3 may be in a range of about ten degrees to about one hundred eighty degrees, and is preferably centered on the radius R.

Such desired volumes emitted from the respective arc portions 102A3-1, 102A3-2, and 102A3-3 may be selected in relation to each other. For example, the volume emitted from the outer portion 102A3-1 may exceed the volume emitted from the middle portion 102A3-2, and the volume emitted from the middle arc portion 102A3-2 may exceed the volume emitted from the inner arc portion 102A3-3, as is described more fully below with respect to FIG. 7D.

It may be understood from the above descriptions of the reference lines 128 and inlets 104 organized along such reference lines, that each arc portion of fluid inlets 104 is configured with a plurality of the fluid inlets 104, and that such inlets 104 are spaced from each other in a closely-packed group represented by the identification "cluster". Further, each such cluster 102A3 may be configured within each such closely-packed group to control values of the volume of the fluid admitted into the chamber 113 at various locations along the radius R. As one example, those locations may correspond to the respective locations of the inlets 104 of each separate cluster 102. A pressure applied to the inlets 104 of the outer arc portion may be P1 and be higher than a pressure P2 applied to the inlets 104 of the next inner arc portion. As a result, a greater volume of the fluid may be supplied to the chamber 113 from the outer arc portion than is supplied to the chamber 113 from the next inner arc portion. As another example, less difference in the pressures P1 and P2 would be required to have the same greater volume from the outer arc portion as compared to the volume from the inner arc portion by configuring the diameters of all or some of the inlets 104 of the outer arc portion larger than the diameters of the inlets 104 of the inner arc portions. Further examples may be apparent based on the above examples of the radius R intersecting successive portions of the reference circles shown in FIG. 4, which would apply to the reference arcs 128.

Figures 6A, 6B, 6C:
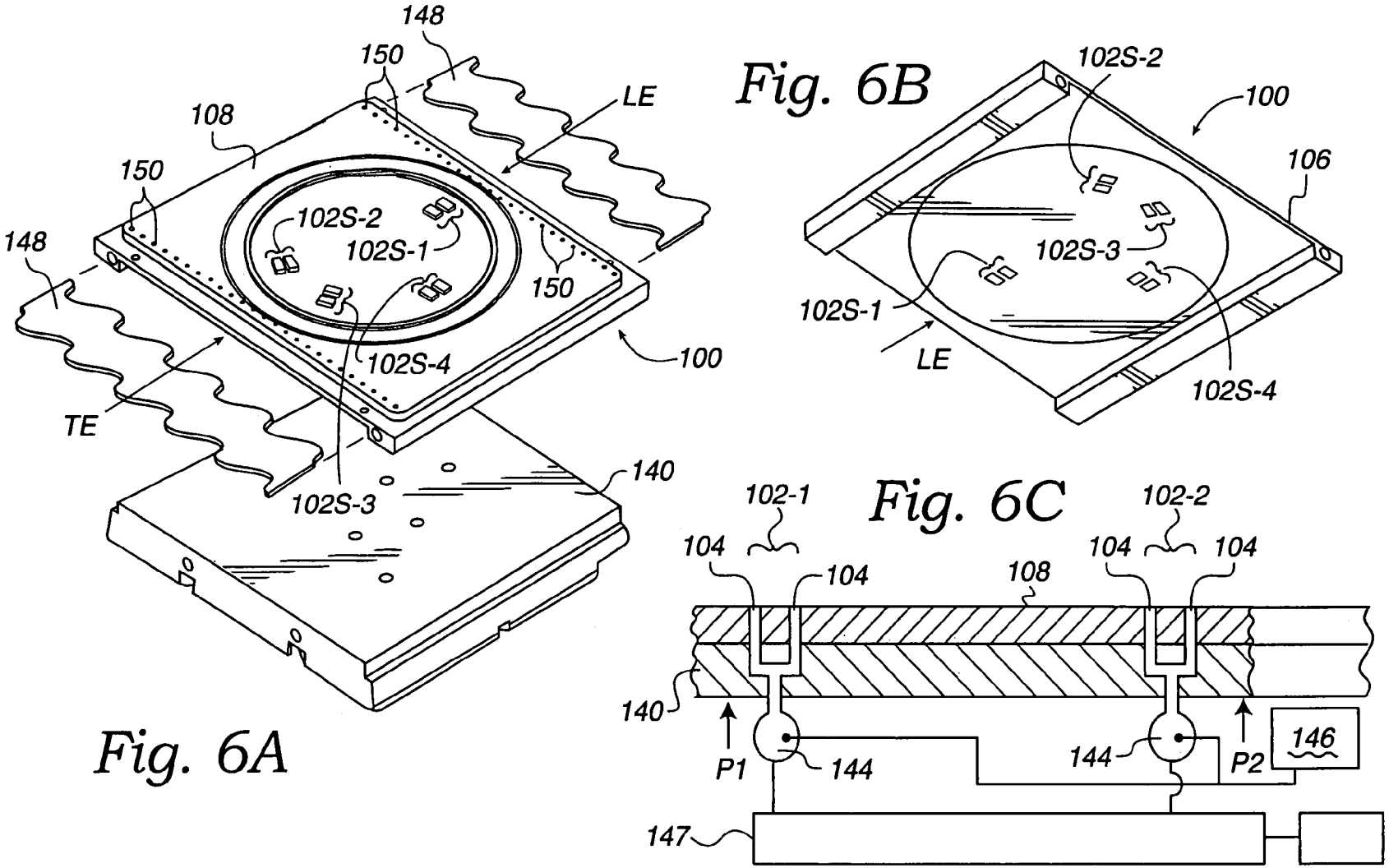
FIG. 6A is an exploded view of the platen overlying an inlet chamber that supplies fluid to the platen, illustrating a polishing pad overlying the platen.
FIG. 6B is a perspective view from below the platen, illustrating the bottom of the platen configured with exemplary clusters of fluid inlets.
FIG. 6C is a schematic view illustrating a system for supplying the fluid to separate ones of the clusters of fluid inlets, the supply being configured to separately control pressure to each of the clusters and to inlets within a cluster.

FIG. 6A is an exploded view of the platen 100 shown overlying a manifold 140). FIG. 6B is a view of the bottom of the platen 100 showing the various sets of clusters, such as the set 102S-1. FIG. 6C is a schematic diagram of the manifold 140 connected to the bottom of main surface 108, and receiving the fluid from various pressure regulators 144. Each regulator 144 may be an electro pneumatic regulator which responds to an input signal. Such regulator 144 senses a pressure downstream of the regulator and controls the downstream pressure according to the input signal. The manifold 140 distributes fluid from each of the many regulators 144 to the respective fluid inlets 104 of the respective clusters 102. Each regulator 144 is supplied with fluid from a plenum 147 connected to a fluid source. Each regulator 144 may be separately controlled by a controller 146. The controller 146 may be a computer of a CMP system 160 that includes the platen 100. The controller 146 may, for example, provide a CMP recipe for the CMP operations, and operate to provide the input signals to control the regulators 144. For example, one regulator 144 may be controlled so that an exemplary pressure P1 may be applied to the fluid inlets 104 of one cluster (shown as 102-1 in FIG. 6C). At the same time the controller may operate to control another regulator 144 so that another exemplary pressure P2 may be applied to the fluid inlets 104 of another cluster (shown as 102-2 in FIG. 6C). These pressures P1 and P2 may be different and be in a range of from about 0.1 psi to about 72 psi. Alternatively, a particular regulator 144 may control the supply to only one or less than all of the fluid inlets 104 that are along a complete reference circle (FIG. 5A), or less than all of the fluid inlets 104 that are along a reference line 128-1 (FIGS. 5B–D) of the various arc clusters 102A or portions 102A2 or 102A3, for example. In this manner, within one cluster 102, and from one cluster 102 to an adjacent cluster 102 of one set 102S, the flow of the fluid may be regulated by a plurality of the regulators 144 to vary the volume of the fluid flowing from particular ones of the fluid inlets 104 into the open top chamber 113 within the particular locations of the respective clusters 102.

Figure 7A:
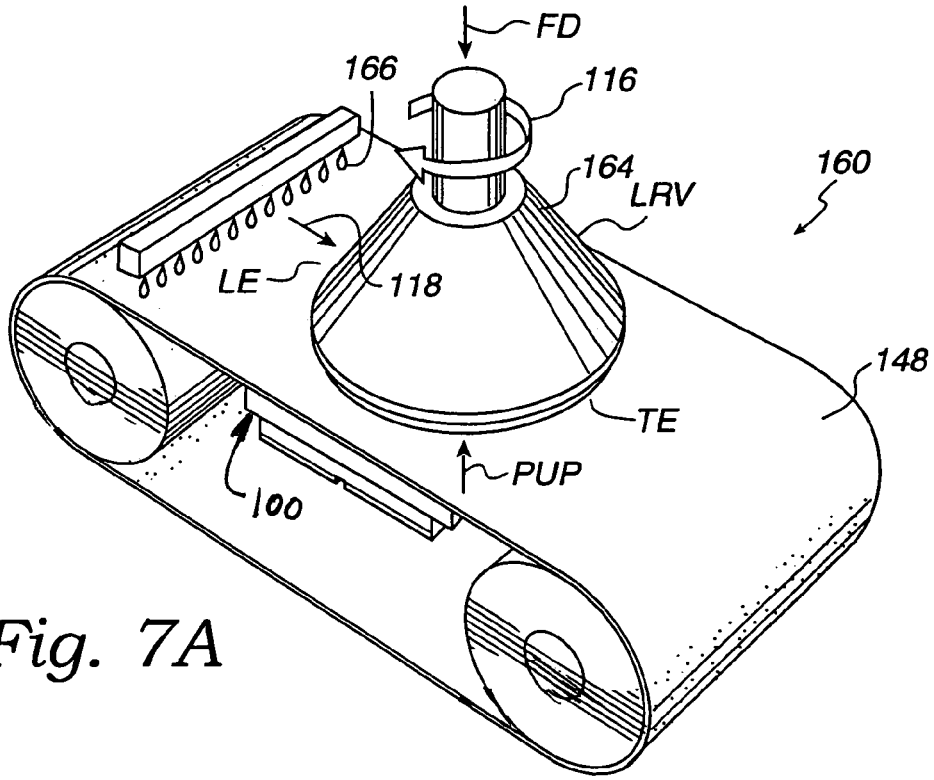
FIG. 7A is a perspective view of a chemical mechanical planarization system of the present invention, illustrating the polishing pad as an endless pad approaching a leading surface of a wafer carried by a carrier head.
Figure 7B:
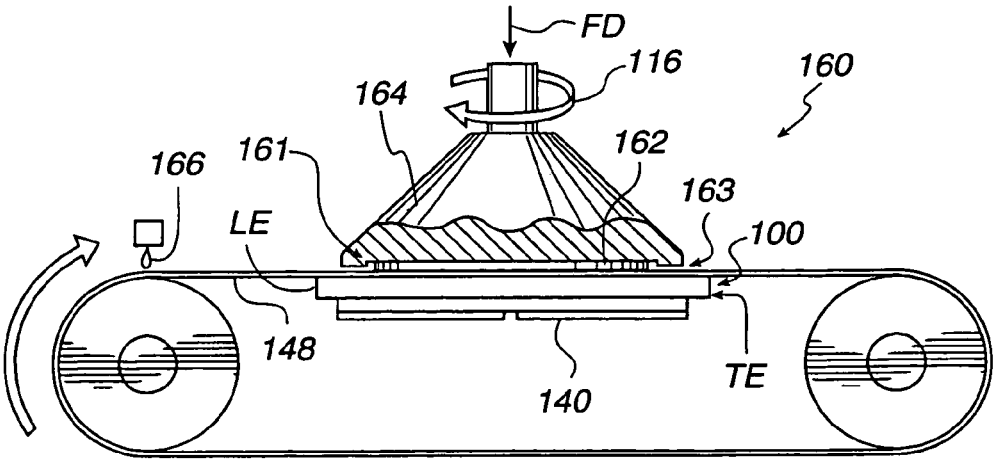
FIG. 7B is a side view of the CMP system shown in FIG. 7A.

FIG. 7A is a perspective view of a chemical mechanical planarization (CMP) system 160 of the present invention, and FIG. 7B is a side view of the CMP system 160. These FIGS. 7A and 7B illustrate the polishing pad 148 as an endless pad having a section approaching the leading edge LE of the platen 110 and approaching a peripheral edge 161 of the above-referenced wafer 162, which wafer is carried by a carrier head 164. The carrier head 164 is shown rotating in the direction 116 and applying the down force FD to urge the wafer 162 downwardly into engagement with the upper surface of the polishing pad 148.

Figure 7C:
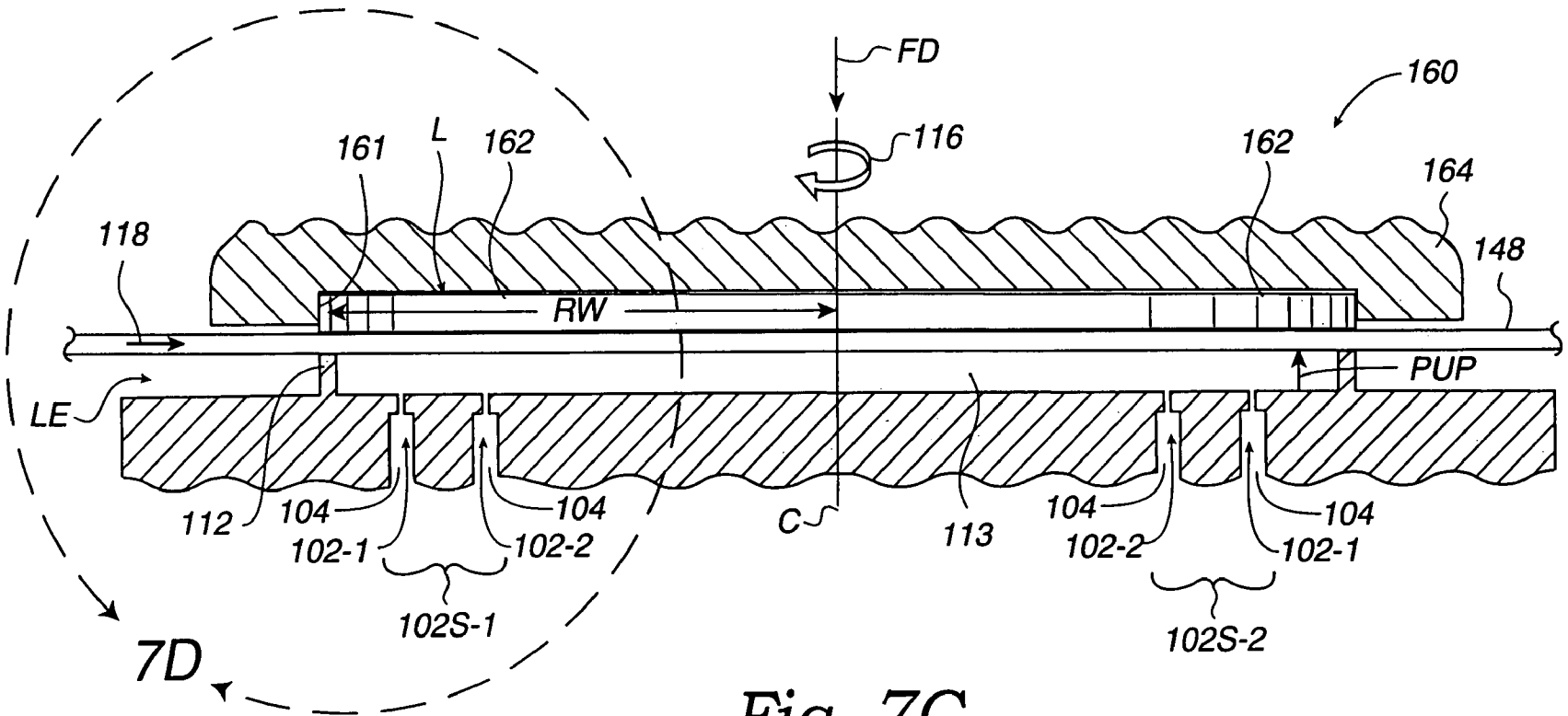
FIG. 7C is a view of a portion of the system shown in FIG. 7A, illustrating a configuration of clusters of fluid inlets.
Figure 7D:
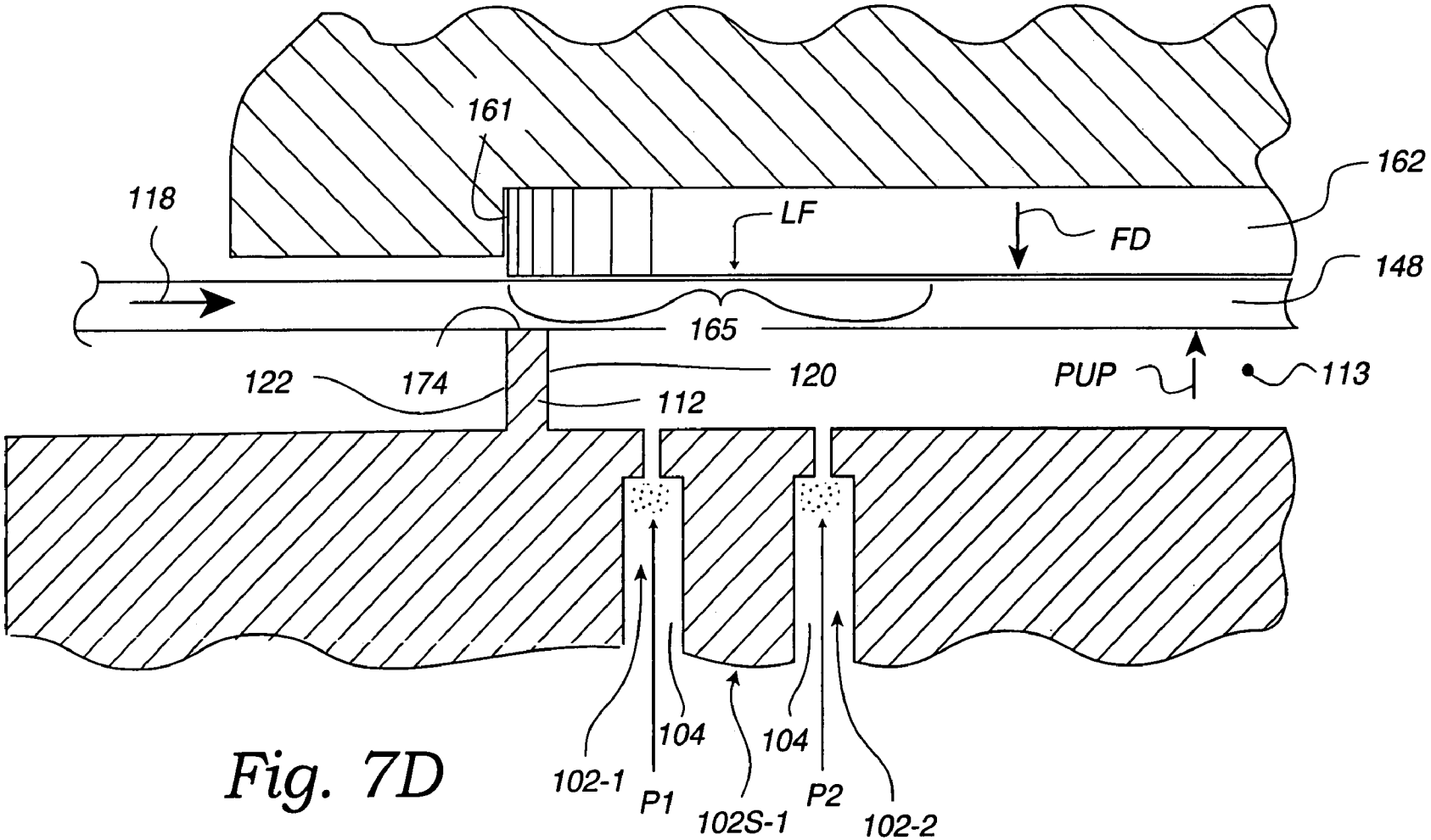
FIG. 7D is an enlarged view of a portion of the system shown in FIG. 7C; illustrating details of the shim aligned with a peripheral edge of the wafer and the configuration of the clusters of fluid inlets.

FIGS. 7C and 7D are progressively larger enlarged views of a portion of the CMP system 160 shown in FIGS. 7A and 7B, illustrating a portion of the shim 112. Inwardly of the peripheral edge 161 the above-described surface of the wafer 162 that may have the pre-CMP process excessive material is the outer annular wafer surface. Such outer annual wafer surface is identified in FIG. 7D by the reference number 165. The surface 165 includes the "leading" wafer surface portion (LWSP). The radial extent of the outer annular wafer surface 165 and the LWSP toward the center C from the peripheral edge 161 is shown by the radial extent of the bracket 165. Referring to FIG. 7D, with respect to an exemplary 300 mm diameter wafer 162 the outer annular wafer surface 165, and the related portion LWSP, extend from the peripheral edge 161 inwardly toward the center C for a distance having a value of from about three mm to about forty-five mm, for example. With respect to an exemplary 200 mm diameter wafer 162 the outer annular wafer surface 165, and the related portion LWSP, extend from the peripheral edge 161 inwardly toward the center C for a distance having a value of from about three mm to about thirty mm, for example. Similarly, when the wafer 162 has rotated one hundred eighty degrees, the outer annular wafer surface becomes positioned adjacent to the trailing edge TE of the platen 100 and extends inwardly of the peripheral edge 161, to become the above-described TWSP of the wafer 162 that is last under the polishing pad 148. The surface 165, with the radial extent shown by the bracket 165, is the described outer annularly-shaped surface located inwardly from the peripheral edge 161, and corresponds to the above-described surface of the wafer that is polished at the higher polishing rate of the fast edge operation.

FIGS. 7C and 7D show the wafer 162 overlapping the shim 112, with the peripheral edge 161 vertically aligned with the outer wall 122 of the shim 112. The force FD applying the downward polishing pressure on the wafer 162 pushes the overlapping wafer 162 against the polishing pad 148, which moves into engagement with a top surface 174 of the shim 112. In this overlapping and aligned relationship, the wafer 162 acting on the polishing pad 148 tends to reduce the amount of the fluid that exits the chamber 113 when the polishing pressure on the wafer 162 from the head 164 is resisted by the pressure PUP of the platen 100 on the polishing pad 148. The polishing pad 148 thus substantially, if not fully, closes the open top chamber 113 and greatly restricts, or limits, a volume of the fluid that exits from the now-closed open-top chamber 113.

Slurry 166 is shown in FIG. 7A supplied onto the polishing pad 148 for the CMP operations, which occur with the wafer 162 urged against the polishing pad 148, and with the platen 100 in cooperation with the plenum 147, the regulators 144, and the manifold 140 (FIG. 6C) supplying the fluid to the fluid inlets 104 of the various clusters 102. As shown in FIGS. 7C and 7D, the fluid in the now-closed, open top chamber 113 provides the upward pressure PUP to resist the downward polishing pressure from the force FD applied by the wafer 162.

FIG. 7D shows the wafer 162 with the peripheral edge 161 in the aligned relationship with the outer wall 122 of the shim 112. One set 102S-1 of the clusters 102 is shown for illustration and includes an exemplary left fluid inlet 104, which may be one of many fluid inlets 104 of one outer cluster 102-1. FIG. 7D shows an exemplary right fluid inlet 104, which may be one of many fluid inlets 104 of one inner cluster 102-2. These clusters 102-1 and 102-2 may be any of the clusters 102 described above, such as with respect to FIGS. 1–4, and 5A–5D, for example. The fluid inlets 104 are connected to the manifold 140 as shown in FIG. 6C so that the pressures P1 and P2 may be selected and cause fluid to flow from the respective inlets 104 into the chamber 113 at locations LF along the radius R, for example. Those locations along the radius R are selected according to the configuration of the platen 100. For example, the configuration of the platen 100 includes the height and width of the shim 112, the locations of the inlets 104 of the respective clusters 102-1 and 102-2 (which locations are relative to the shim 112 as described in paragraphs [0043] and [0045], for example above), the selection of the type of cluster 102 (e.g., selection from one of FIGS. 4, or 5A–5D, for example), the diameters of the inlets 104, and the other variables described above.

Figure 8A:
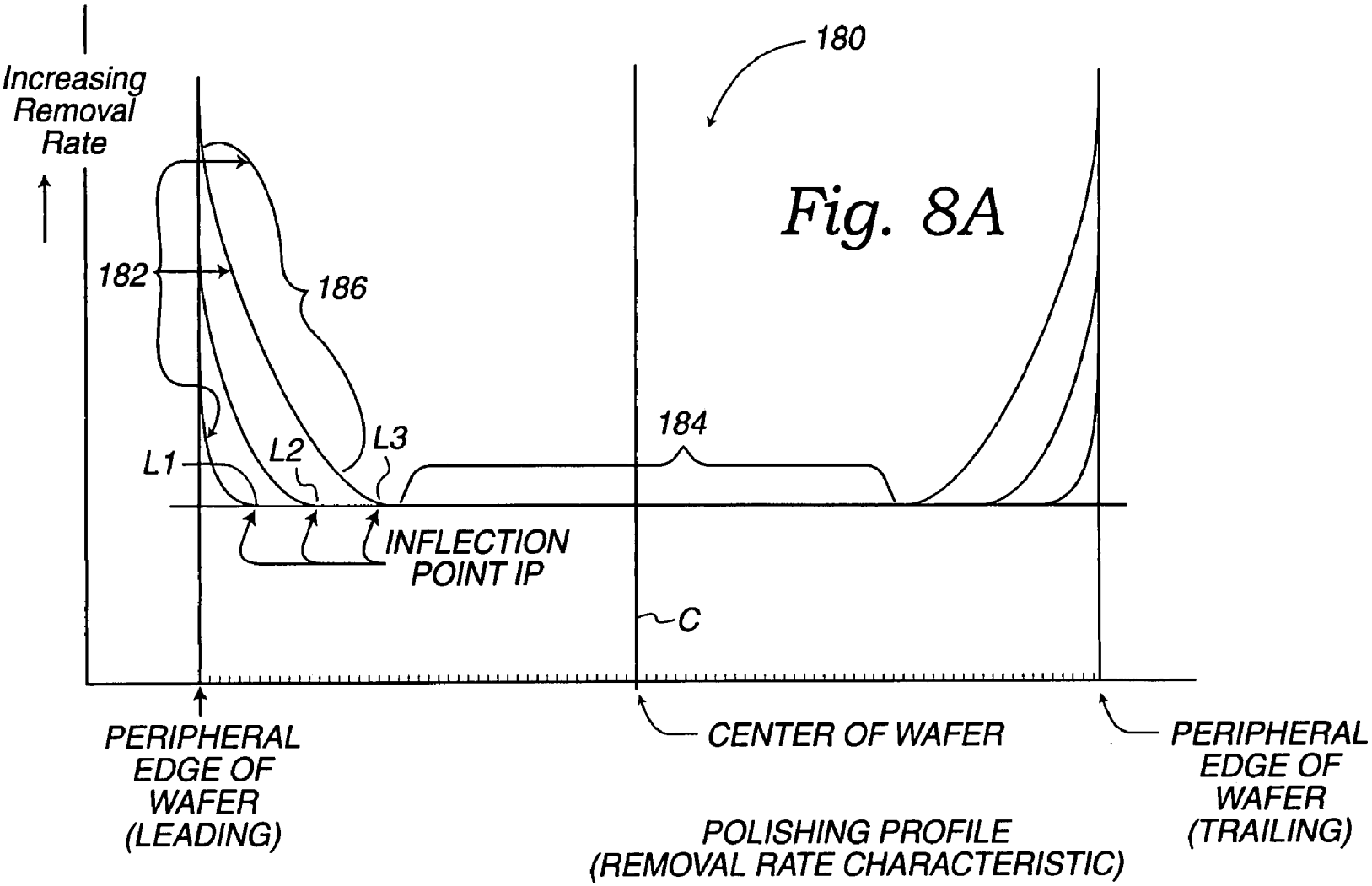
FIG. 8A is a graph depicting an operating characteristic of the system in the form of a removal rate characteristic, illustrating an inflection point parameter of each of a plurality of curves of the graph.

The benefits of the configuration and operation of the platen 100 may be understood in connection with FIG. 8A, which is a graph 180 depicting an exemplary operating characteristic of the system 160. This operating characteristic is a removal rate characteristic. In respect to the configuration of the platen 100 and the use of such platen 100 during CMP processing, the removal rate characteristic defines a desired rate of removal of material from the wafer 162 as a function of location on the wafer 162. In FIG. 7C, such location may be along the radius RW of the wafer 162, and one such location is shown as L. Such location L may also be described as being along a polished lower surface of the wafer 162 that is presented to and urged against the polishing pad 148. Aspects of the present invention enable desired parameters of the removal rate characteristic to be defined according to configurations of the platen 100, where CMP processing uses that configured platen 100. One such parameter is the shape of the removal rate characteristic, and another parameter is an inflection point IP. One inflection point IP is shown on each of three exemplary curves 182 of the graph 180. In each case, the inflection point IP is a point at which a relatively constant removal rate (see portion 184 of curve 182) suddenly changes to an increased removal rate (see portion 186 of curves 182). The inflection point IP on the graph 180 at which this sudden change occurs corresponds to a location L (FIG. 7C) on the polished surface of the wafer 162. Such location L is adjacent to the peripheral edge 161, and is within the leading wafer surface 165 (FIG. 7D). One location L may correspond to a location such as L3 of the inflection point IP shown on the graph 180 of FIG. 8A.

In the present invention, the platen 100 may be configured to enable a selected one of exemplary locations L1, L2, and L3 (FIG. 8A) to be the location of the inflection point IP that occurs during use of that configured platen 100 in CMP operations. It may be said, then, that by way of specific configuration of the platen 100, the location L (FIG. 7C, e.g., L1, L2, or L3 of FIG. 8A) of the inflection point IP is variable. By such configuring, that one parameter (the location, e.g., L1) of the removal rate characteristic may be controlled.

It may be understood that specific configurations of the platen 100 may be provided for varying the location L of the inflection point IP. One such specific configuration is by providing one exemplary cluster 102 at one of the positions shown, for example, in FIG. 5A or 5B. The one cluster 102 may be at the location described above as "more-closely" adjacent to the shim 112. That more closely adjacent location is with the one inlet 104 of the one cluster 102 being within the range of about 10 to 125 mils from the shim 112. The spacing of that one inlet 104 from the shim 112 is indicated by a value of the dimension CA in FIG. 5A, for example. The value of the dimension CA is selected in conjunction with the height and width of the shim 112, for example. With the one cluster 102 at the selected location, and the shim 112 configured, the pressure P1 is applied to the inlets 104 of the one cluster 102 under the control of the controller 146. The fluid is emitted from the location LF of the fluid inlets 104 (FIG. 7D). The rotating wafer 162 is urged against the polishing pad 148 by the down force FD and with the peripheral edge 161 aligned with the outer wall 122 of the shim 112. The down force FD results in the polishing pressure being applied to the surface of the wafer 162, including to the outer annular wafer surface 165. The pressure P1 acts upwardly and applies the pressure PUP under the polishing pad. The value of the pressure P1 is selected to exceed the polishing pressure so that a fast edge results. The removal rate characteristic shown in FIG. 8A illustrates that by this configuration of the platen 100, with the fluid emitted at the location LF into the chamber 113, the location L of the inflection point IP may be at one of the exemplary locations L1, L2, or L3.

It may be understood that other specific configurations of the platen 100 may be achieved for varying the location L of the inflection point IP. One such other specific configuration is by providing the two clusters 102 at the positions shown, for example, in FIGS. 1, 4, or 5C. The outer of the two clusters 102 may be at the location described above as "more-closely" adjacent to the shim 112. That location is with the one inlet 104 of the outer cluster 102 (e.g., cluster 102-1, FIG. 4) being within the range of about 10 to 125 mils from the shim 112. The spacing of that one inlet 104 from the shim 112 is indicated by a value of the dimension CA in FIG. 5C, for example. The value of the dimension CA is selected in conjunction with the height and width of the shim 112, for example. As shown in FIG. 5C, the reference line 128-2 references the second arc portion 102A2-2 of the cluster 102A2. The inner arc portion 102A2-2 is adjacent to the leading edge LE. The inner arc portion 102A2-2 (shown in FIG. 7D as 102-2) is also at the location LF (FIG. 7D) between the outer arc portion 102A2-1 (shown in FIG. 7D as 102-1) and the center C (FIG. 1). That location is along the radius R, and is selected with respect to the desired location L of the inflection point IP. In more detail, with the central section 110 continuous within the shim 112 and around the two clusters 102A2-1 and 102A2-2 shown in FIG. 5C, the central section 110 is uninterrupted by any fluid hole, except for the fluid inlets 104 of those two clusters. As a result, along the radius R from the center C, the first fluid admitted into the chamber 113 is admitted from the inner cluster 102A2-2, and the location LF of such inner cluster along the radius R governs the location L of the inflection point IP.

In the operation of these exemplary three clusters 102A2-1 and 102A2-2, with the inner cluster 102A2-2 at the selected location LF, a total pressure PT, which is a sum of the pressure P1 (applied to the cluster 102A2-1) and the pressure P2 (applied to the cluster 102A2-2), is applied to the inlets 104 of these two clusters under the control of the controller 146. The rotating wafer 162 is urged against the polishing pad 148 by polishing pressure from the down force FD, with the peripheral edge 161 aligned with the outer wall 122 of the shim 112. The polishing pressure is applied to the surface of the wafer 162, including to the outside annular wafer surface 165. The total pressure PT acts upwardly and applies the pressure PUP (FIG. 7D) under the polishing pad. The value of the total pressure PT is selected to exceed the polishing pressure so that a fast edge results. The pressure P2 is effective at the location LF of the inner cluster 102A2-2 to provide the removal rate characteristic shown in FIG. 8A, which illustrates that by this configuration of the platen 100, the location L of the inflection point IP may be at one of the exemplary locations L1, L2, or L3. It may be understood that still other specific configurations of the platen 100 may be achieved for varying the location L of the inflection point IP. One such other specific configuration is by providing the three clusters 102 at the positions shown, for example, in FIG. 5D. The reference line 128-3 there references the third (inner) arc portion 102A3-3 of the cluster 102A3. The inner arc portion 102A3-3 is also at a location between the middle arc portion 102A3-2 and the center C (FIG. 1). That location is along the radius R, and is selected with respect to the desired location of the inflection point IP. In detail, with the central section 110 continuous within the shim 112 and around the three clusters 102A3-1, 102A3-2, and 102A3-3 shown in FIG. 5D, the central section 110 is uninterrupted by any fluid hole, except for the fluid inlets 104 of those three clusters. As a result, along the radius R from the center C, the first fluid admitted into the chamber 113 is admitted from the inner cluster 102A3-3, and the location of such inner cluster along the radius R governs the location of the inflection point IP.

In the operation of these exemplary three clusters 102A3-1, 102A3-2, and 103A3-3, with the inner cluster 102A3-3 at the selected location, there is a total pressure PT. The total pressure PT is a sum of the pressure P1 (applied to the cluster 102A3-1), and a pressure P3 (not shown, and applied to the middle cluster 102A3-2), and the pressure P2 (applied to the inner cluster 102A3-3). The total pressure PT is applied to the inlets 104 of these three clusters under the control of the controller 146. The rotating wafer 162 is urged against the polishing pad 148 by the down force FD, with the peripheral edge 161 aligned with the outer wall 122 of the shim 112. The down force FD results in the polishing pressure being applied to the surface of the wafer 162, including to the leading wafer surface 165. The total pressure PT acts upwardly and applies the pressure PUP under the polishing pad. The value of the total pressure PT is selected to exceed the polishing pressure so that a fast edge results. The pressure P2 is effective at the location of the inner cluster 102A3-3 to provide the removal rate characteristic shown in FIG. 8A, which illustrates that by this configuration of the platen 100, the location of the inflection point IP may be at one of the exemplary locations L1, L2, or L3.

Figure 8B:
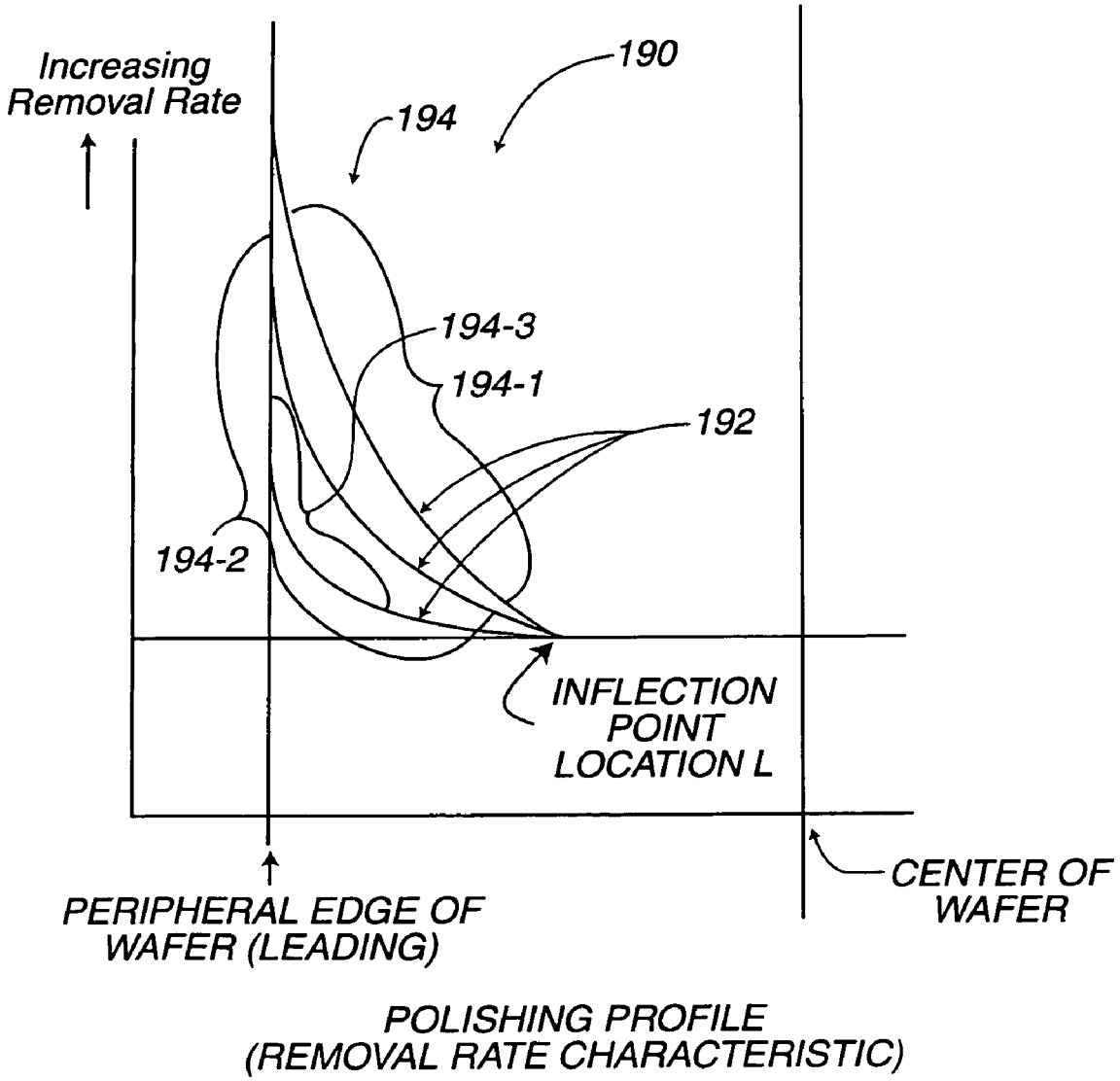
FIG. 8B is another graph of the removal rate characteristic, illustrating variations of another parameter, which is a shape of curves of the graph, wherein the shapes indicate the removal rate characteristic at a fast edge of the wafer.

As described above, another parameter of the removal rate characteristic that may be controlled according to configurations of the platen 100 is the shape of the removal rate characteristic. FIG. 8B shows one inflection point IP at a particular location L as may have been selected as described above. Each removal rate characteristic curve 192 of FIG. 8B has an exemplary constant removal rate between the center and the inflection point IP. However, each curve 192 is shown with an exemplary different shape 194, which is a removal rate that occurs on the wafer 162 between the inflection point IP and the peripheral edge 161 (FIG. 7D). Exemplary shapes 194 of the removal rate characteristic curves 192 include a shape 194-1, which is flatter than a more-curved shape 194-2, which in turn is still flatter than a more-curved shape 194-3. The so-called "flatter" shape is a less gradual, or more abrupt, shape. In this example of the one cluster 102, the controller 146 (FIG. 6C) controls a value of the pressure P1 applied to the inlets 104 of the one cluster 102. The pressure P1 is relative to the polishing pressure so that the value of the pressure P1 not only exceeds the polishing pressure, but the amount by which that value is in excess of the polishing pressure determines the shape 194 of the removal rate characteristic. Exemplary shapes 194 of the removal rate are indicated at 194-1, 194-2, and 194-3, for example. This excess amount may vary according to the diameters of the inlets 104 of the cluster 102, or according to the particular type of the close-packed configuration that is selected for the one cluster 102.

As described above, the shape of the removal rate characteristic is the other parameter of the removal rate characteristic that may be controlled according to configurations of the platen 100. As noted, FIG. 8B shows one inflection point IP at a particular location L as may have been selected as described above by the configuration of the exemplary two clusters 102A2-1 and 102A2-2. Considering a particular configuration of those exemplary clusters 102A2-1 and 102A2-2, for example, the controller 146 (FIG. 6C) controls the values of the total pressure PT by controlling the individual separate pressures P1 and P2. Such control is first relative to the polishing pressure, so that the value of the total pressure PT always exceeds the polishing pressure when a fast edge is desired. Second, the controller 146 controls the values of the separate pressures P1 and P2 to determine the shape of the removal rate characteristic. In more detail, the controller 146 sets the respective separate pressures P1 and P2 so that with the sum of P1 and P2 exceeding the polishing pressure, the pressure P1 of the outer cluster 102A2-1 and the pressure P2 of the inner cluster 102A2-2 are in a ratio having a value exceeding one. Such ratio provides the selected, or desired, or given, shape of the CMP removal rate characteristic between the inflection point IP and the peripheral edge 161 of the wafer 162. As a result, a greater volume of the fluid may be supplied to the chamber 113 from the outer cluster 102A2-1 than is supplied to the chamber 113 from the second, or inner, cluster 102A2-2. Exemplary shapes of the removal rate are indicated at 194-1, 194-2, and 194-3, for example. These values of the pressures P1 and P2 may vary according to the diameters of the inlets 104 of the cluster 102, or according to the particular type of the close-packed configuration that is selected for the one cluster 102, for example.

The shape of the removal rate characteristic may be controlled according to another configuration of the platen 100, which may be the configuration of the exemplary three clusters 102A3-1, 102A3-2, and 102A3-3. Considering a particular configuration of these three clusters, for example, the controller 146 (FIG. 6C) controls the values of the total pressure PT by controlling the individual separate pressures P1, P2 and P3. Such control is first relative to the polishing pressure, as described above. Second, the controller 146 controls the values of the separate pressures P1, P2 and P3 to determine the shape of the removal rate characteristic. The controller 146 sets the respective separate pressures P1, P2, and P3. The sum of P1, P2, and P3 exceeds the polishing pressure. As a result, a greater volume of the fluid may be supplied to the chamber 113 from the outer and middle respective clusters 102A3-1 and 102A3-2, than is supplied to the chamber 113 from the inner cluster 102A3-3. Exemplary shapes of the removal rate are indicated at 194-1, 194-2, and 194-3, for example. These values of the pressures P1 and P2 may vary according to the diameters of the inlets 104 of the cluster 102, or according to the particular type of the close-packed configuration that is selected for the one cluster 102, for example.

In FIG. 8B, such shapes 194 of the curves 192 are illustrated for the same location of the inflection point IP to make a clearer shape comparison, it being understood that by suitable configuration of the platen 100, the inflection point location (e.g., L1) may also be changed, or selected, at the same time as the shape 194 of the curve 192 is selected. This selection of the shape 194 of the removal rate characteristic curve 192 may, for example, be accomplished by suitable configuration of the various clusters 102 of the fluid inlets 104 of the platen 100. For example, referencing FIG. 5C, the individual fluid inlets 104 of the inner portion 102A2-2 may be evenly spaced from each other along the arcuate reference line 128-2, and may be in such number as emits a desired volume of fluid into the chamber 113. Such desired volumes emitted from the respective portions 102A2-1 and 102A2-2 may be selected in relation to each portion, such that the volume emitted from the outer portion 102A2-1 may exceed the volume emitted from the inner portion 102A2-2. This result is similar to a result of the pressure P1 applied to an outer cluster 102-1 being greater than the pressure P2 applied to the inner cluster 102-2 (see paragraph [0071], for example). As a further example, the arc cluster 102A2-2 may also be configured with more than five fluid inlets 104, and the diameters of such inlets 104 may be in the higher end of the range of from about ten mils to about sixty mils, and the length of the arcuate reference line 128-2 may be longer than the line 128-1. These exemplary configurations of the inner cluster 102A2-2 may enable reduction of the value of the pressure P2 applied to the inner cluster 102A2-2, and enable change of the ratio which governs the shape of the removal rate. Another way of selecting the shape 194 of the removal rate characteristic curve 192 may, for example, be based on the selection of a particular one of the regulators 144 in association with one particular cluster 102-1 (FIG. 6C). Another regulator 144 may apply pressure to the fluid inlets 104 of another cluster 102-2 (FIG. 6C). Alternatively, a particular regulator 144 may control the supply to less than all of the fluid inlets 104 that are along a complete reference circle (FIG. 5A), or less than all of the fluid inlets 104 that are along a reference line 128-1 (FIGS. 5B–D) of the various arc clusters 102A or that are along portions 102A2 or 102A3, for example. In this manner, within one cluster 102, and from one cluster 102 to an adjacent cluster 102 of one set 102S, by the configuration of the clusters 102 and the corresponding respective regulators 144 to control the pressure applied to the clusters, or to the portions of a cluster 102, the flow of the fluid may be regulated by a plurality of the regulators 144 to vary the volume of the fluid flowing from particular ones of the fluid inlets 104 into the open top chamber 113 within the particular locations of the respective clusters 102. By such exemplary configurations, the desired shapes 194 of the removal rate characteristic curve 192 may be selected during configuration of the platen 100, and by the operation of the controller 146 and the regulators 144 with the configured platen 100, during the CMP operations those desired shapes may be obtained on the post-CMP polished wafers 162.

In the manner described above, the fluid inlets 104 are configured to direct the fluid upwardly in opposition to the location of the leading wafer surface portion (LWSP) to achieve the desired location L of the inflection point IP and the desired shape of the curves 192 in the CMP operations. Further, such control of the shape parameter of the removal rate characteristic may be obtained after installation of the platen in the system 160, e.g., during final set-up of the CMP system 160 using the platen 100, and with the controller 146 to set the above-described pressures applied to the various fluid inlets 104, e.g., pressures P1 and P2, for example.

Figure 9A:
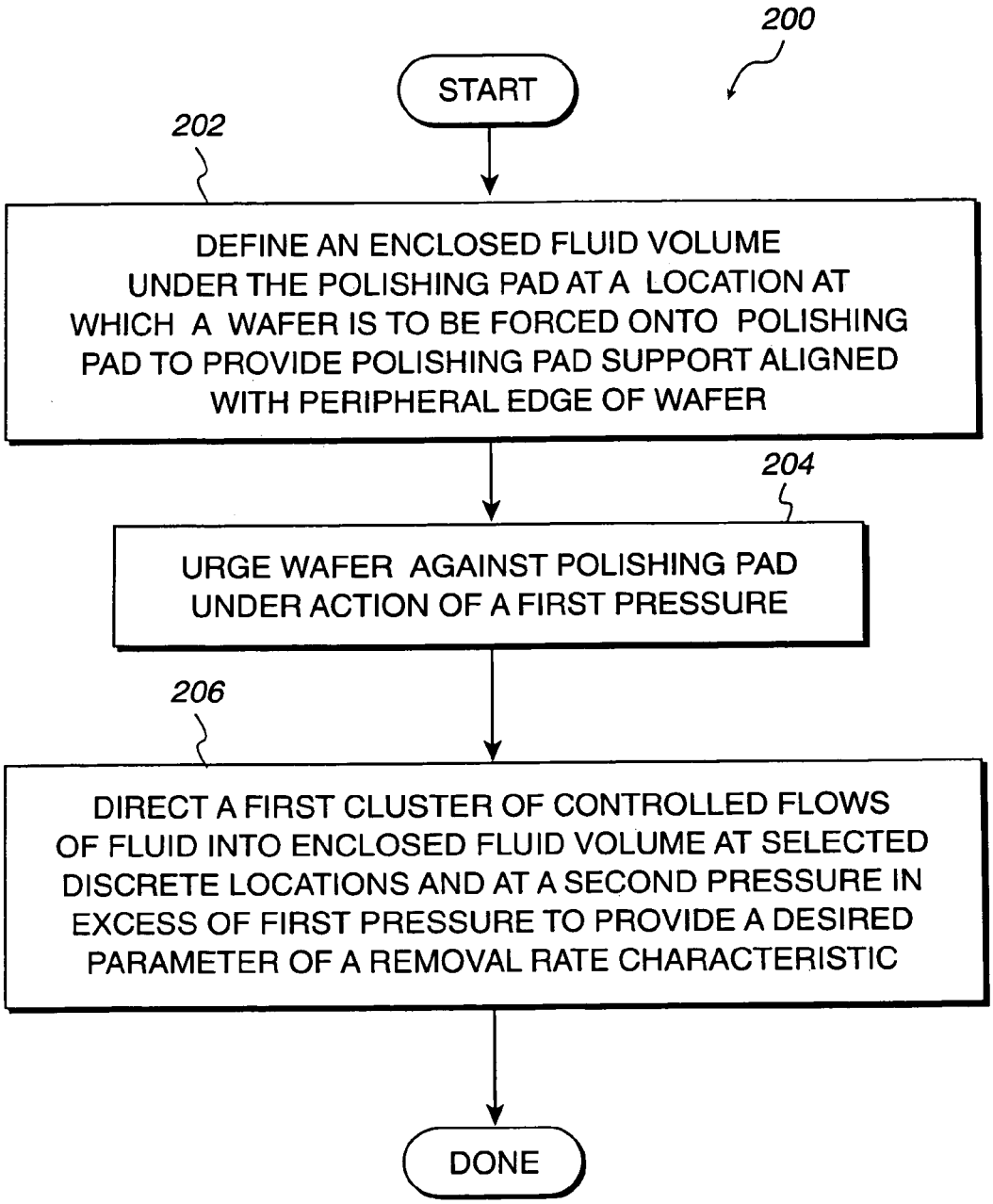
FIG. 9A illustrates a flow chart that shows a method of the present invention by which a location of the inflection point may be selected.

FIG. 9A illustrates a flow chart 200 showing a method of the present invention. The method controls pressure beneath a polishing pad in a CMP operation to define a desired parameter of a CMP removal rate characteristic. The method may include an operation 202 of defining an enclosed fluid volume, such as the open top cavity, or chamber, also referred to as a volume, 113, which is under the polishing pad 148 at the location at which the wafer 162 is to be forced onto the polishing pad 148. This volume 113 is closed by the polishing pad 148 when the wafer 162 is so forced onto the polishing pad. This location of forcing is shown in FIG. 7C, for example. The enclosed volume 113 has a continuous perimeter corresponding to (i.e., within) the peripheral edge 161 of the wafer to provide a polishing pad support aligned with the peripheral edge 161 of the wafer. Such continuous perimeter corresponds to the peripheral edge 161 of the wafer. The method moves to an operation 204 of urging the wafer 162 against the polishing pad 148 under the action of the polishing pressure. The urging is with the down force FD that results in the polishing pressure. The value of the down force FD is set by the CMP polishing recipe that governs the CMP processing operations. Under control of the controller 146, the pressure PUP exerted on the polishing pad 148 by the platen 100 is greater than the polishing pressure, so that the fast edge operation is obtained. The forcing urges the wafer surface, including the leading wafer surface 165, against the polishing pad 148. The method moves to an operation 206 of directing a first cluster of controlled flows of fluid into the enclosed fluid volume 113. The directing is at such pressures (e.g., the above pressure P1, P2, etc.) in the respective fluid inlets 104 of the clusters 102 that the pressure PUP exceeds the polishing pressure. With the clusters 102 configured as described above, the controlled flows result from the fluid being emitted from the respective fluid inlets 104 and into the now-closed volume 113. FIG. 7D shows one exemplary inlet 104 of the cluster 102-2. That cluster 102-2 may be the inner cluster 102A2-2 shown in FIG. 5C. That inner cluster 102A2-2 (shown as 102-2 in FIG. 7D) is in position to direct one of the flows at a selected discrete location L (e.g., LF). That location LF is adjacent to the continuous perimeter 161 and is in opposition to the leading wafer surface portion LWSP of the outer annular wafer surface 165. In combination, the flows from the inlets 104 of the inner cluster 102-2 are at many closely spaced, discrete locations LF that are selected to provide one of the desired parameters of the removal rate characteristic. That one desired parameter of the removal rate characteristic is the location L (e.g., L1, FIG. 8A) of the inflection point IP. In more detail, by the configuration of the platen 100 with the exemplary inner cluster 102A2 (FIG. 5C) at a selected location along the radius R, the discrete flow locations LR are selected to position the inflection point IP at the predetermined location L adjacent to the peripheral edge 161 during the CMP operations. That is, the locations L1, L2, and L3 shown in FIG. 8A for the inflection point IP are predetermined as determined by the location LF of the exemplary inner cluster 102-2. When only one cluster 102 is used, such as in FIGS. 5A and 5B, the locations L1, L2, and L3 shown in FIG. 8A for the inflection point IP are predetermined as determined by the location LF of that one cluster 102.

Figure 9B:
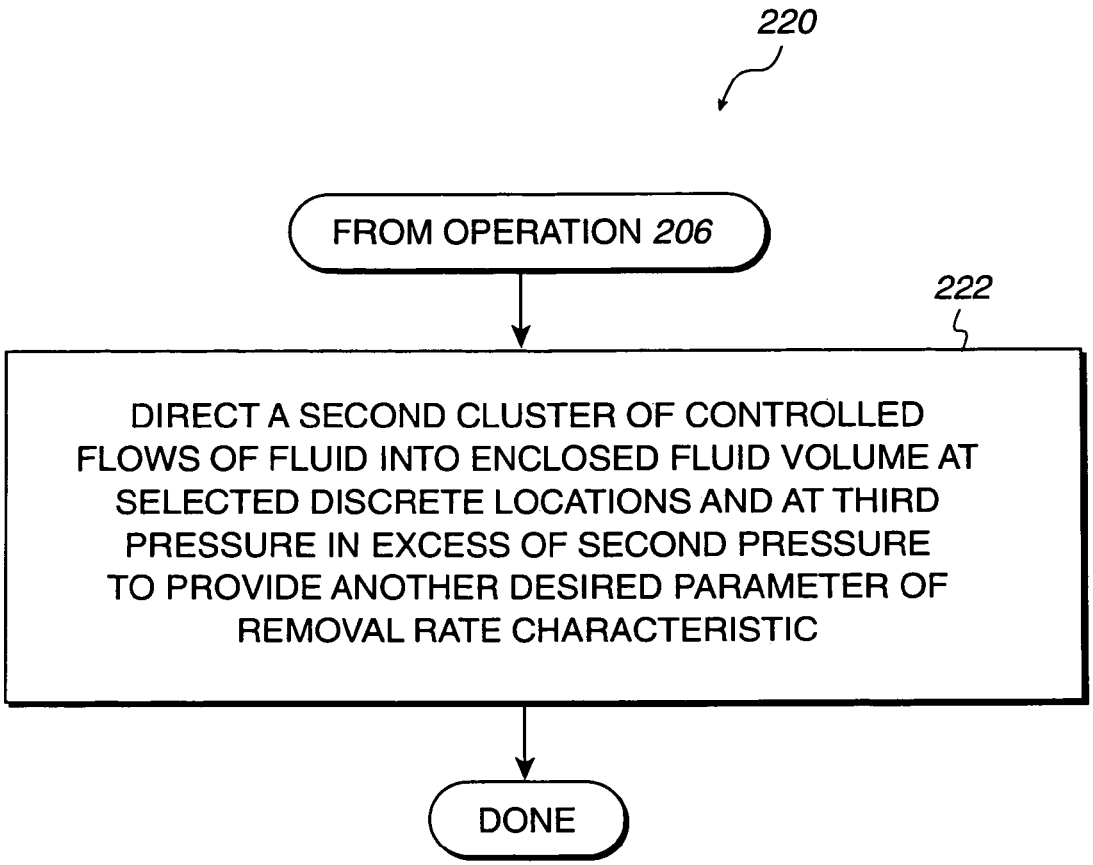
FIG. 9B illustrates another flow chart that shows a method of the present invention by which the shapes of the curves of the graph may be varied to control the removal rate characteristic at a fast edge.

FIG. 9B illustrates a flow chart 220 showing a further operation of the method of the present invention. The method may be performed after the operation 206, and further controls the pressure beneath the polishing pad in the CMP operation to define another desired parameter of the CMP removal rate characteristic. The method may include an operation 222 of directing at least a second cluster of controlled flows of fluid into the enclosed fluid volume 113. The pressure at which this directing takes place exceeds the pressure applied to the exemplary inner cluster 102A2-2 shown in FIG. 5C. These pressures include the respective pressure P1 for the described second cluster of controlled flows (the outer flows). These pressures include the respective pressure P2 for the described first cluster of controlled flows (the inner flows). A sum of the pressures P1 and P2 exceeds the polishing pressure. The second cluster of controlled flows is directed at selected discrete second locations LF that are between the selected discrete first locations L (FIG. 7D) and the continuous perimeter 161.

Another aspect of the operation 222 relates to the pressure P1 and the pressure P2 being in a ratio having a value exceeding one. Once the desired type of clusters 102 has been selected, and the inlets 104 of the selected clusters 102 have been configured, the pressure applied to those inlets 104 determines that ratio, and that ratio provides a selected, or given, shape of the CMP removal rate characteristic between the inflection point IP and the peripheral edge 161 of the wafer. Referring to FIG. 8B, exemplary shapes 194 of the curves 192 are illustrated. It is to be understood that by suitable configuration of the platen 100, the inflection point location (e.g., L1) may be changed, or selected, at the same time as the shape 194 of the curve 192 is selected. This selection of the shape 194 of the removal rate characteristic curve 192 may be accomplished by suitable configuration of the various clusters 102 of the fluid inlets 104 of the platen 100.

In review, the operations 206 and 222 of directing the first and second clusters of controlled flows control amounts of the respective flows from the respective first and second clusters. As a result, an amount of fluid directed into the volume 113 varies with the distance of a particular one of the fluid flows from the continuous perimeter, which corresponds to the shim 112, and to the outer wall 122. This variation is to direct into the volume 113 progressively more and more air from the fluid flows as the fluid flows are positioned closer and closer to the continuous perimeter, or shim 112. This progressively more and more air from the fluid flows as the fluid flows are positioned closer and closer to the continuous perimeter, or shim 112, results in the shape 194 of each of the exemplary curves 192 shown in FIG. 8B. By observing the various shapes 194-1 through 194-3 it may be understood that the more the amount of fluid directed into the volume 113 increases as the location of the flows becomes closer to the continuous perimeter, the steeper the curve 192 will be. Thus, the shape 194-1 represents a sudden increase in the amount of fluid directed into the volume 113 as the location of the flows becomes closer to the continuous perimeter. In contrast, the shape 194-3 represents a less sudden increase in the amount of fluid directed into the volume 113 as the location of the flows becomes closer to the continuous perimeter.

In view of the foregoing description, it is apparent that the present invention provides methods of and a platen 100 for controlling the removal rate characteristic, such as those parameters of the exemplary graphs 180 and 190, for CMP operations. Further, that characteristic may be controlled while using the low-cost polishing pad 148, e.g., having Kevlar-brand material that is useful in fast edge operations, for example. That characteristic may also be controlled while reducing the amount of fluid used to support the polishing pad 162. As described, one platen configuration (FIG. 7C, shim 112 with configured outer wall 122 aligned with peripheral edge 161 of the wafer) reduces leakage of fluid from beneath the polishing pad 162. A related configuration of the platen 100 (FIGS. 5A and 5B with single clusters 102 and 102A) controls the location, e.g., L1, of the inflection point IP of the removal rate characteristic (FIG. 8A). Another related configuration of the platen 100 (FIGS. 5A through 5D, with variations of sizes and locations LF of the inlets 104 to enable use of the different pressure ratios, e.g., of pressures P1 and P2) controls a shape of a section of the removal rate characteristic between the inflection point IP and the peripheral edge 161 of the wafer 162 (FIG. 8B, sections 194 of the curves 192, for example). By thus providing this control in the important fast edge operation, one may achieve the benefits of being able to perform CMP operations to remove material that (pre-CMP processing) built-up at the outer annular wafer surface 165 greater than an exemplary 10 mm from the peripheral edge 161, while additional benefits are maintained. First is the use of the low-cost polishing pad 148 having the Kevlar-brand material, for example. Second is that the reductions of the amount of fluid used to support the polishing pad 162 are achieved as compared to platens that do not have the described shims 112. Also, by the exemplary cluster configurations, a desired inflection point location may be selected, and the desired shapes 194 of the removal rate characteristic curve 192 may be selected not only during configuration of the platen 100, but the shapes may be obtained by the operation of the controller 146 and the regulators 144 with the configured platen 100. Thus, during the CMP operations the operation of the controller 146 and the regulators 144 with the configured platen 100 obtain those desired shapes on the post-CMP polished wafers 162.

The invention has been described herein in terms of several exemplary embodiments. The above described embodiments may be applied to rotary or orbital type CMP systems. Other embodiments of the invention will be apparent to those skilled in the art from consideration of the specification and practice of the invention. The embodiments and preferred features described above should be considered exemplary, with the invention being defined by the appended claims.

What is claimed is:

1. A platen for chemical mechanical planarization (CMP) of a wafer having a disk-like configuration, comprising:

a platen body configured with a leading edge, a main surface comprising a disk-like configuration corresponding to that of the wafer and extending from adjacent to the leading edge along a radius to a center of the disk-like configuration of the main surface, and a shim configured with an outer circular shim wall surrounding the disk-like configuration of the main surface to define a chamber, the shim being further configured so that during a CMP operation a wafer peripheral edge is vertically aligned with the outer shim, the shim being further configured with an inner shim wall;

the platen body being further configured with a cluster of fluid inlets surrounded by the inner wall and positioned adjacent to both the leading edge and the inner shim wall; and the main surface being continuous within the inner shim wall and around the cluster of fluid inlets.

2. A platen as recited in claim 1, wherein the platen has a removal rate characteristic during the CMP operation, the removal rate characteristic being a variation of a rate of material removed from the wafer as a function of location along a polished surface of the wafer, the characteristic including an inflection point at which a relatively constant removal rate suddenly changes to an increased removal rate adjacent to the wafer peripheral edge, and wherein the configuration of the platen body positions the cluster of fluid inlets relative to the inner shim wall so that the inflection point is located at a predetermined location relative to the wafer peripheral edge.

3. A platen as recited in claim 1, wherein the platen has a removal rate characteristic during the CMP operation, the removal rate characteristic having at least one parameter and being a variation of a rate of material removed from the wafer as a function of location along a polished surface of the wafer between a center of the wafer and the wafer peripheral edge, the at least one parameter including an inflection point at which a relatively constant removal rate suddenly changes to an increased removal rate, and wherein:

the platen body is further configured to control values of the increased removal rate as a function of distance between the inflection point and the wafer peripheral edge, the further configuration being by configuring the fluid inlets of the cluster of fluid inlets relative to the inner wall of the shim, the cluster of fluid inlets comprising a plurality of fluid inlets spaced from each other in a closely-packed group and configured within the group to control values of the increased removal rate between the inflection point and the wafer peripheral edge.

4. A platen as recited in claim 3, wherein the configuration of the cluster of fluid inlets within the closely-packed group is taken from the group consisting of:

a series of concentric circles centered on the radius, a series of fluid inlets arranged along an arc extending generally parallel to the inner wall of the shim and centered on the radius, and an array of fluid inlets arranged along each of a plurality of arcs that extend generally parallel to the inner wall of the shim, wherein each of the arcs is centered on the radius.

5. A platen as recited in claim 4, wherein the plurality of arcs are configured with a first arc closely adjacent to the inner shim wall and at least one additional arc spaced from the first arc toward the center, and wherein the fluid inlets along the first arc are more closely spaced than the fluid inlets along the additional arc.

6. A platen as recited in claim 5, wherein the at least one additional arc are a second and a third arc, wherein the second arc is spaced from the first arc toward the center, wherein the third arc is spaced from the second arc toward the center, and wherein the fluid inlets along the first arc are more closely spaced than the fluid inlets along the second arc, and wherein the fluid inlets along the second arc are more closely spaced than the fluid inlets along the third arc.

7. A platen as recited in claim 1, wherein the platen has a removal rate characteristic during the CMP operation, the removal rate characteristic being a variation of a rate of material removed from the wafer as a function of location along a polished surface of the wafer, the characteristic including an inflection point at which a relatively constant removal rate suddenly changes to an increased removal rate adjacent to the peripheral edge of the wafer, and wherein the configuration of the platen body with the cluster of fluid inlets is a configuration with a first cluster of fluid inlets and with a second cluster of fluid inlets separate from the first cluster, the first cluster being surrounded by the inner wall and positioned adjacent to both the leading edge and the inner shim wall, the first cluster being located adjacent to the radius, the second cluster being surrounded by the inner wall and positioned between the first cluster and the center closely adjacent to the first cluster and located adjacent to the radius, the main surface being continuous within the inner shim wall and around each of the first and second clusters of fluid inlets, the location of the second cluster of fluid inlets being effective to position the inflection point at a predetermined location relative to the wafer peripheral edge.

8. A platen as recited in claim 1, wherein the platen has a removal rate characteristic during the CMP operations, the removal rate characteristic having various parameters and being a variation of a rate of material removed from the wafer as a function of location along a polished surface of the wafer between a center of the wafer and the peripheral edge of the wafer, the parameters including an inflection point at which a relatively constant removal rate suddenly changes to an increased removal rate adjacent to the wafer peripheral edge, and wherein:

the platen body is further configured to control values of the increased removal rate as a function of distance between the inflection point and the wafer peripheral edge, the further configuration being by providing a second cluster of fluid inlets adjacent to the first-recited cluster, the second cluster being positioned between the first-recited cluster and the center and closely adjacent to the first-recited cluster, the platen body configuration to control the values being a configuration of the fluid inlets of the first-recited and second clusters of fluid inlets relative to the inner wall of the shim, each of the first-recited and second clusters of fluid inlets comprising a plurality of fluid inlets spaced from each other in a closely-packed group, each closely-packed group being configured within the group and relative to the other group to control the values of the increased removal rate between the inflection point and the peripheral edge.

9. A platen for chemical mechanical planarization (CMP) of a wafer having a wafer configuration, comprising:

a platen body configured with a leading edge, a main surface comprising a configuration corresponding to that of the wafer and extending from adjacent to the leading edge along a first radius to a center of the configuration of the main surface and along a second radius to a trailing edge, and a shim configured with an inner shim wall surrounding the configuration of the main surface to define a chamber, the shim being further configured with an outer shim wall that during a CMP operation is vertically aligned with a peripheral edge of the wafer, a third radius extending from the center at a first angle with respect to the second radius and extending to the inner shim wall, a fourth radius extending from the center at a second angle with respect to the second radius and extending to the inner shim wall;

the platen body being further configured with a first cluster of fluid inlets located adjacent to both the leading edge and the first radius;

the platen body being further configured with a second cluster of fluid inlets located adjacent to both the trailing edge and the third radius;

the platen body being further configured with a third cluster of fluid inlets located adjacent to both the trailing edge and the fourth radius; and the main surface being continuous within the inner shim wall and around all of the clusters of fluid inlets.

10. A platen as recited in claim 9, wherein the platen body is further configured with respective fourth, fifth, and sixth additional clusters of fluid inlets between the center and each of the respective first cluster of fluid inlets, second cluster of fluid inlets, and third cluster of fluid inlets, and wherein the main surface is continuous within the inner shim wall and around the first cluster of fluid inlets and around the respective fourth additional cluster of fluid inlets and around the second cluster of fluid inlets and around the respective fifth additional cluster of fluid inlets and around the third cluster of fluid inlets and around the respective sixth cluster of fluid inlets.

11. A platen as recited in claim 10, wherein the platen is configured to have a removal rate characteristic during the CMP operation, the removal rate characteristic having a plurality of parameters and being a variation of a rate of material removed from the wafer as a function of location along a polished surface of the wafer, the parameters including an inflection point at which a relatively constant removal rate suddenly changes to an increased removal rate at a location adjacent to the peripheral edge of the wafer, and wherein the configuration of the platen body locates the respective clusters of fluid inlets so that the inflection point is positioned at a predetermined location relative to the peripheral edge of the wafer.

12. A platen as recited in claim 11, wherein the respective first and fourth clusters of fluid inlets and the respective second and fifth clusters of fluid inlets and the respective third and sixth clusters of fluid inlets are configured with a plurality of the fluid inlets arranged to provide a desired shape of the removal rate between the inflection point and the peripheral edge of the wafer.

13. A platen as recited in claim 12, wherein each of the clusters of fluid inlets comprises a plurality of fluid inlets spaced from each other in a closely-packed group and configured within the group to control values of the increased removal rate between the inflection point and the peripheral edge of the wafer, wherein the configuration of each closely-packed group of fluid inlets within the respective closely-packed group is taken from the group consisting of:

a series of concentric circles centered on the radius, a series of fluid inlets arranged along an arc extending generally parallel to the inner wall of the shim and centered on the radius, and an array of fluid inlets arranged along each of a plurality of arcs that extend generally parallel to the inner wall of the shim, wherein each of the arcs is centered on the radius.

14. A platen as recited in claim 13, wherein the plurality of arcs are configured with a first arc closely adjacent to the inner shim wall and at least one additional arc spaced from the first arc toward the center, and wherein the fluid inlets along the first arc are more closely spaced than the fluid inlets along the additional arc.

15. A platen as recited in claim 14, wherein the at least one additional arc are a second and a third arc, wherein the second arc is spaced from the first arc toward the center, wherein the third arc is spaced from the second arc toward the center, and wherein the fluid inlets along the first arc are more closely spaced than the fluid inlets along the second arc, and wherein the fluid inlets along the second arc are more closely spaced than the fluid inlets along the third arc.

16. A platen as recited in claim 11, wherein the respective plurality of the fluid inlets of the respective first and fourth clusters of fluid inlets and of the respective second and fifth clusters of fluid inlets and of the respective third and sixth clusters of fluid inlets are configured to provide a desired shape of the removal rate characteristic between the inflection point and the peripheral edge of the wafer according to a ratio of a first pressure to a second pressure, the first pressure being a pressure of fluid applied to the respective first, second and third clusters, the second pressure being a pressure of fluid applied to the respective fourth, fifth and sixth clusters.

17. A platen as recited in claim 16, wherein a value of the first pressure exceeds a value of the second pressure, and a sum of the first and second pressures exceeds a pressure applied to the wafer during the CMP operation.

18. A system for supporting a polishing pad in CMP operations performed on a wafer having a peripheral edge, comprising:

a platen body configured with a relatively flat upper surface and a leading edge;

an annularly-shaped shim having an inner shim wall and an outer shim wall, the shim being secured to and extending above the relatively flat upper surface to define a central wafer support bounded by the outer shim wall, the shim being configured to conform to the wafer by being configured with an outer shim wall diameter corresponding to a diameter of the wafer;

separate inner and outer clusters of air inlet holes extending through the flat upper surface at respective inner and outer cluster locations on the platen body, the cluster locations being within the central wafer support, the flat upper surface being continuous within the central wafer support and around the respective outer and inner clusters, the outer cluster location being closely adjacent to the inner shim wall, the inner cluster location being between the outer cluster location and a center of the central wafer support and closely adjacent to the outer cluster location, the inner cluster location being configured to position an inflection point at a selected location adjacent to the peripheral edge, the inflection point being a location at which a relatively constant removal rate suddenly changes to an increased removal rate, wherein the respective fluid inlets of the respective inner and outer clusters of fluid inlets are configured to provide a desired shape of the removal rate between the inflection point and the peripheral edge according to a ratio of a first pressure to a second pressure;

a source of pressurized air; and a controller system configured to separately connect the clusters to the source and apply the first and second pressures, the first pressure being an air pressure separately applied to the air inlet holes of the respective outer cluster, the second pressure being an air pressure separately applied to the air inlet holes of the respective inner cluster, wherein a desired removal rate characteristic is obtained during the chemical mechanical planarization of the wafer.

19. A platen as recited in claim 18, wherein each of the outer and inner clusters of air inlet holes comprises a plurality of air inlet holes, the air inlet holes of one cluster being spaced from each other in a closely-packed group and configured within the group to respond to the respective first and second pressures to control values of the increased removal rate between the inflection point and the peripheral edge, wherein the configuration of each closely-spaced group of air inlets within the closely-packed group is taken from the group consisting of:

a first series of air inlets arranged along concentric circles centered on the radius, a second series of air inlets arranged along an arc extending generally parallel to the inner wall of the shim and centered on the radius, and a third series of air inlets arranged along each of a plurality of arcs that extend generally parallel to the inner wall of the shim, wherein each of the arcs of the third series is centered on the radius and those arcs are located at progressively greater distances from the inner shim wall.

20. A platen as recited in claim 19, wherein each of the first, second and third series of air inlets is configured so that an amount of air admitted through the air inlets varies with the distance of the air inlets from the shim, the configuration being to progressively admit more air from the air inlets as the air inlets are spaced less and less from the shim.

21. A method for controlling pressure beneath a polishing pad in a CMP operation to define desired parameters of a CMP removal rate characteristic, the method comprising the operations of:

defining an enclosed volume under the polishing pad at a location at which a wafer is to be urged onto the polishing pad, the enclosed volume having a continuous perimeter corresponding to a peripheral edge of the wafer to provide a polishing pad support aligned with the peripheral edge of the wafer;

urging the wafer against the polishing pad under the action of a first pressure; and directing a first cluster of controlled flows of fluid into the enclosed fluid volume at a second pressure that exceeds the first pressure, the controlled flows being directed at selected discrete first locations and adjacent to the continuous perimeter, the discrete first locations being selected to provide one of the desired parameters of the removal rate characteristic.

22. A method as recited in claim 21, wherein the discrete first locations are selected with respect to an inflection point as one of the desired parameters of the removal rate characteristic, the inflection point being a location at which a relatively constant CMP removal rate suddenly changes to an increased removal rate; and wherein the discrete first locations are selected to position the inflection point at a predetermined location adjacent to the peripheral edge.

23. A method as recited in claim 22, comprising the further operation of directing a second cluster of controlled flows of fluid into the enclosed fluid volume at a third pressure with a sum of the second and third pressures exceeding the first pressure, the second cluster of controlled flows being directed at selected discrete second locations between the selected discrete first locations and the continuous perimeter.

24. A method as recited in claim 23, wherein the operations of directing the first and second clusters of controlled flows comprise controlling amounts of the respective flows of the respective first and second clusters so that an amount of fluid directed into the volume varies with the distance of a particular one of the fluid flows from the continuous perimeter, the variation being to direct into the volume progressively more air from the fluid flows as the fluid flows are positioned closer and closer to the continuous perimeter.

25. A method as recited in claim 22, comprising the further operation of controlling the second and third pressures so that with the sum exceeding the first pressure, the third pressure and the second pressure are in a ratio having a value exceeding one to provide a selected given shape of the CMP removal rate characteristic between the inflection point and the peripheral edge of the wafer.

* * * * *